US011087910B2

(12) United States Patent
Walsh

(10) Patent No.: US 11,087,910 B2
(45) Date of Patent: Aug. 10, 2021

(54) MAGNETIC POTENTIAL ENERGY BARRIER

(71) Applicant: Raymond James Walsh, Island Park, ID (US)

(72) Inventor: Raymond James Walsh, Island Park, ID (US)

( * ) Notice: Subject to any disclaimer, the term of this patent is extended or adjusted under 35 U.S.C. 154(b) by 0 days.

(21) Appl. No.: 16/827,652

(22) Filed: Mar. 23, 2020

(65) Prior Publication Data

US 2020/0234863 A1 Jul. 23, 2020

Related U.S. Application Data

(60) Provisional application No. 62/821,955, filed on Mar. 21, 2019.

(51) Int. Cl.
*H01F 7/02* (2006.01)

(52) U.S. Cl.
CPC ..... *H01F 7/0294* (2013.01); *H01F 7/0221* (2013.01); *H01F 7/0242* (2013.01); *H01F 7/0284* (2013.01)

(58) Field of Classification Search
CPC ..... H01F 7/0205; H01F 7/021; H01F 7/0221; H01F 7/0226; H01F 7/0231; H01F 7/0242
See application file for complete search history.

(56) References Cited

U.S. PATENT DOCUMENTS 4,912,727 A * 3/1990 Schubert ..... F16C 29/00
248/206.5

* cited by examiner

*Primary Examiner* — Ramon M Barrera
(74) *Attorney, Agent, or Firm* — Miller Nash LLP

(57) ABSTRACT

Theoretical and practical constraints disallow direct determination of the structure of the atomic nucleus. Contained herein is a magnet model of the atomic nucleus, derived from considerations of charge density, RMS charge radii, magnetic moments, and nucleon binding energy. These physical properties point to a sequential, alternating up and down quark structure modeled in the present invention by an array of magnets alternating in polarity. The summation of the pull forces of the two magnet poles is unequal, and when two such magnet arrays are placed opposite one another in magnetic potential energy barrier assembly, the two arrays repel at a distance and attract when near one another. In one embodiment, the ratio of the maximum attractive force to the maximum repulsive force very closely approximates the strong force constant 137. This invention serves as a demonstration of the Coulomb barrier for the student, and a potentially useful model for probing the forces and structure of the atomic nucleus.

6 Claims, 27 Drawing Sheets

Models of the Atomic Nucleus, Norman Cook.

Size and Magnetic Moments of Light Nuclei proton: $R_p = 0.8751(61)\times10^{-15}$ m. deuteron: $R_d = 2.1413(25)\times10^{-15}$ m.

Proton quark resonant states

Neutron quark resonant states up quark down quark electron

MAGNETIC POTENTIAL ENERGY BARRIER

CROSS-REFERENCE TO RELATED APPLICATION

This application claims benefit from U.S. provisional patent application No. 62/821,995, filed Mar. 21, 2019, entitled "NUCLEAR FUSION MODEL," the disclosure of which is incorporated herein by reference in its entirety.

BACKGROUND

A potential energy barrier exists between two objects when a force of repulsion at a distance increases as the objects approach before giving way to a force of attraction when the objects are sufficiently close.

The coulomb barrier is an example of a potential energy barrier. Far range repulsion arises from the electrostatic force between two approaching positively-charged nuclei. This repulsive force increases with the inverse square of the distance as the nuclei approach one another up to a maximum. When sufficiently close, the electrostatic repulsive force gives way to a strongly attractive force known as the strong force or strong nuclear force. The nuclei come together in nuclear fusion, with the concomitant release of energy.

The author is aware of no classical examples of a potential energy barrier, and this phenomenon is difficult to demonstrate in the classroom. Yet an understanding of the mechanisms involved in achieving nuclear fusion may be critical to meeting our long-term energy needs.

Mechanisms of nuclear fusion likely derive from the composition, structure, and forces of the atomic nucleus. A classroom model of a potential barrier would ideally reflect the structure and the behavior of constituent forces leading to fusion. The greater the number of students and scientists who understand the fusion process the greater the likelihood of an affordable breakthrough. A review of what is known and believed about the structure and forces of the atomic nucleus is in order.

The structure of the nucleus begins with Rutherford's gold foil experiment. Alpha particles accelerated at a piece of gold foil were expected to pass easily through the foil. Most alpha particles passed easily through, but a few bounced back. From this simple experiment we know that the atom is mainly empty space but has a very dense nucleus.

This dense nucleus was found to contain protons, having a +1 charge and discovered in 1923, and neutrons having a 0 charge and discovered in 1932. In the 1950s, electron beams shown through these nucleons (protons and neutrons) indicated each had three smaller particles or partons. Subsequent collider experiments indicated that these particles have a charge, one particle having a charge of −⅓ and a second having a charge of +⅔.

The theory of quantum chromodynamics (QCD) was formalized in the 1970s, according to which the −⅓ charged particle is a down quark and the +⅔ particle an up quark. Given that the charge on a neutron is 0 and the charge on a proton is +1, simple arithmetic yields the composition of the two particles: The neutron is composed of two down quarks and one up quark, and the proton is composed of two up quarks and a down quark.

At the core of QCD is the theory of the strong nuclear force, which holds quarks and nucleons together within the atomic nucleus despite electrostatic forces. According to QCD, each quark at any given time has a color charge in addition to electrostatic charge. Color charge is 137 times stronger than electrostatic charge, and there are three types of color charge: red, green, and blue. The rule is simple: unlike colors attract. While two adjacent up quarks might experience a repulsive electrostatic force owing to their positive charges, if one is green and the other is blue then the strong force would result in an attraction 137 times stronger than the electrostatic repulsive force. The number 137 is the strong force coupling constant, the reciprocal of the fine structure constant. The residual strong force, a sort of strong force halo surrounding nucleons, is responsible for holding protons and neutrons together within the nucleus.

The most common presentation of nucleon structure according to QCD is to arrange the three quarks in an equilateral triangle. It is axiomatic that structure, including charge distribution, should drive observable physical properties. The basic physical properties of light nuclei are shown in Table 1. It should be possible to work backwards from these physical properties to arrive at the structure of light nuclei.

TABLE 1

| | n-1 | H-1 | H-2 | H-3 | He-3 | He-4 |
|---|---|---|---|---|---|---|
| RMS Charge Radius (fm) | 0.8* | 0.88 | 2.14 | 1.76 | 1.97 | 1.68 |
| Magnetic Moment ($\mu_N$) | −1.91 | +2.79 | +0.86 | +2.98 | −2.13 | 0 |
| Nucleon Binding Energy (MeV/nucleon) | — | — | 1.0 | 2.75 | 2.5 | 7.0 |

*Estimated.

For medium and heavy nuclei beyond an atomic mass of 15, the nuclear size follows a curvilinear path and the nucleon binding energy saturates. This more predictable relationship between atomic mass number and physical properties has guided over 30 theories of nuclear structure for medium and heavy nuclei. Still, none of these theories enjoy broad consensus. Most ignore the equilateral triangular quark structure of QCD, instead treating nucleons as simple point sources having no substructure. The pursuit of a framework for the structure of heavier nuclei, then, has not provided great insight into the structure of light nuclei.

For light nuclei, working backwards from an equilateral triangular quark geometry to rationalize the resultant physical properties shown in Table 1 is problematic.

For example, the neutron charge density as shown in FIG. 3 indicates a positively charged core 305 with a negative shell 303. A neutron has two down quarks and an up quark. An equilateral triangular arrangement of the two negatively charged down quarks and one positively charged up quark could not yield such a charge distribution. A linear or sequential arrangement of alternating quarks, however, with the positive up quark in the middle and the two down quarks, agrees completely with the observed charge distribution of the neutron.

A linear alternating sequence of quarks also produces a better fit for the size or RMS charge radii of the light nuclei, in contrast to QCD, as shown in FIG. 4. First consider the proton and deuteron. QCD treats the proton as a hard sphere containing three quarks moving randomly within. The RMS charge radius of the proton 401 is 0.86 fm (purists may quibble). The deuteron 413 has two nucleons, a proton and a neutron. Assuming these are roughly the same size, the predicted deuteron size would be 1.72 fm, more or less. The experimentally determined size of a deuteron, however, is much bigger at 2.14 fm. So the QCD prediction for the size of a deuteron is within about 80%.

The QCD prediction for He-4 is not much better. If we arrange the 4 nucleons of helium-4 into a tightly packed tetrahedron, the predicted RMS charge radius would be 1.94 fm. The actual charge radius is 1.65 fm, so the predicted is about 118%.

In contrast, a linear or sequential arrangement of alternating quarks within the proton yields a length of 1.72 fm as shown in FIG. 4, twice the RMS charge radius of 0.86 fm. Assuming a linear alternating sequence of quarks, the deuteron has a length 4.28 fm, twice the RMS charge radius of the deuteron is 2.14 fm. As shown in FIG. 5, the proton 501 is 2 units long, with a unit being equivalent to the RMS charge radius of the proton (and the distance between quarks in a proton). By this same measure, the deuteron 503 is 5 units long. Dividing the RMS charge diameter of the deuteron by 5 gives the distance between quarks in a deuteron: (4.28 fm)/5=0.856 fm. This represents a nearly exact 99.5% agreement with the RMS charge radius of a proton, as compared to the 80% prediction of QCD. Likewise, arranging the 9 quarks of H-3 601 and He-3 603 into a sequential horseshoe shape as shown in FIG. 6 permits easy agreement with experimentally determined values.

Similar nearly exact agreement can be found for He-4 605 when its 12 quarks are arranged in a circle. He-4 has an RMS charge radius of 1.65 fm and thus a diameter of 3.3. One possible structure for He-4 is a linear alternating sequence of up and down quarks, 12 total, arranged as a regular dodecagon, or 12-gon, as shown in FIG. 6. Assuming the distance between quarks in He-4 is the same as the distance between quarks in a proton, then the length of a dodecagon side 607 equals 0.86 fm. Plugging this value into the formula for the circumradius of a dodecagon yields a circumradius of 1.66 fm. The measured RMS charge radius of He-4 is 1.65 fm, representing a nearly exact 99.4% agreement.

Furthermore, a circular closed loop structure for He-4 may explain it's unusually high nucleon binding energy compared to H-3 or He-3 as listed in Table 1. In nuclei with an even number of protons and neutrons, each nucleon finds a partner in a phenomenon known as nuclear pairing. A closed loop of alternating up and down quarks must necessarily have an even number of each. Such a loop, containing an even number of nucleons, is more energetically bound than nuclei having an odd number of nucleons such as H-3 and He-3. This may explain the lower binding energy for H-3 and He-3 compared to He-4 as shown in Table 1.

The simplistic explanation for the higher binding energy of nucleons within a loop (such as He-4) derives from the geometry of a loop of nucleons. Each nucleon is bound to two other nucleons, one on either side. When an alternating sequence of quarks does not form a loop, such as H-3 and He-3, the terminal nucleons are bound to only one other nucleon. Thus, less energy is required to separate these terminal nucleons.

The closed loop geometry of He-4 may foreshadow the structure of heavier nuclei, which also tend to exhibit the nuclear pairing phenomenon. Heavier nuclei may form large loops that twist and fold into a compact nucleus. In FIG. 7, the 16 nucleons of oxygen are shown as a loop in the left pane 701 which is twisted in the middle pane 703 and then folded in the right pane 705 to form a compact nucleus. As loop size (and atomic number) increases, the folded loop would inevitably form layers or shells, with some loop sizes fitting more tightly (greater stability) and others more loosely (lesser stability).

Such folded loops would inevitably have spaces between strands, as shown in the right pane 705 of FIG. 7. The number of spaces would only increase with increasing loop size (corresponding to increasing atomic number). It is known that a greater number of protons within a nucleus requires an increasing number of neutrons for stability, stable nuclei forming a "valley of stability". Thus it is possible that the increasing number of spaces within increasing loop size are filled with an increasing number of neutrons. These neutrons would essentially bridge the gap or space between neighboring strands and thus act as a sort of scaffolding to the nuclear structure as a whole.

And here's a bit of corroborating evidence that these extra neutrons fit within the existing structure: The physical size of a nucleus, or RMS charge radius, correlates overwhelmingly with the atomic number Z. The excess neutrons, those exceeding the mass number A minus twice the atomic number Z, do not significantly increase the size of the nucleus, contributing less than 1%.

Alpha decay, too, may arise as a consequence of increasing loop size. The structure suggested by RMS charge radius of He-4 is a dodecagon, which has an internal angle at each vertex of 150 degrees. This may represent the limit of flexure of an alternating quark sequence. This means that if a large loop were to twist into a figure-8 shape with overlapping and intersecting strands (similar to middle pane 703, FIG. 7), the smallest possible loop would be a He-4 nucleus. The larger the isotope the greater the possibility of twisting and pinching off a He-4 nucleus.

The closed-loop structure of He-4 is consistent with a magnetic moment of zero, as compared to the proton and deuteron in FIG. 4. To understand how structure relates to magnetic moment we must review the precepts of magnetism as relates to quark precession.

Quark precession involves circular movement of quarks. The source of all magnetism is the movement of charge, and the source of all magnetic dipoles is the movement of charge in a circle. In the case of a permanent magnet, tiny amperian loops of current collectively produce the N/S dipole. In a permanent magnet motor, it is current moving around copper coils. In the case of atomic nuclei, magnetic dipoles/moments derive from Larmor precession of quark charge. (This forms the basis of NMR chemical analysis and MM medical imaging).

Larmor precession as shown in FIG. 8 involves circular movement of charge, and it is circular movement of charge (i.e. Amperian loops of current) that generates a magnetic field and magnetic moment. The proton 801 is shown as a linear sequence of alternating quarks, an up quark on either side of a down quark. The +2.79 magnetic moment of the proton derives from the circular movement of the two terminal up quarks 803, while the circular movement of the two terminal down quarks 805 of the neutron 807 produce the −1.91 magnetic moment of the neutron. The proton and neutron both have a pivot quark (809 and 811 respectively) in the middle that doesn't move and therefore does not contribute to the magnetic moment. From this we may conclude that a circulating up quark produces a positive dipole moment and a circular down quark produces a negative sign for the dipole moment.

The deuteron 817, in contrast, has no pivot quarks. In FIG. 8, the deuteron appears as a neutron stacked on top of a proton, and all six quarks are precessing. The terminal quarks 813 and 815 of the deuteron on either end probably circulate over a wider path than the constrained inner quarks; nonetheless, the experimentally determined magnetic moment of the deuteron is +0.86, which is quite close to +0.88, the sum of the magnetic moments of the constituent neutron and proton.

He-4 has a zero value for the magnetic moment. Its structure must, therefore, preclude or disallow quark precession. The circular quark structure for He-4 suggested earlier by the RMS charge radius would not favor precession, and would therefore result in the observed He-4 magnetic moment of zero. All twelve quarks are inner quarks and there are no terminal quarks. Additionally, the dodecagon vertices may effectively bind quarks from precessing. The circular alternating quark structure of He-4 disallows quark movement. Without movement of charge there can be no magnetism, ergo the magnetic moment of He-4 is zero.

H-3 and He-3 present a unique case in the quest to relate structure to physical property. Each has nine quarks. When this sequence of 9 alternating quarks is arranged in the horseshoe shape suggested by the RMS charge radii as shown in FIG. 6, the structures are nearly identical but have opposite quark sequences.

Thus H-3 has two terminal down quarks 602 while He-3 has two terminal up quarks 604. The magnetic moments are +2.98 and −2.13 respectively. If the proton and neutron magnetic moment magnitudes are any indication (near 2 or 3), and the proton and neutron each have 2 precessing quarks of like charge, then the magnitude of the magnetic moments of both H-3 and He-3 may also suggest two precessing quarks with like charge.

But the charge of the magnetic moments of H-3 and He-3 are opposite what one might expect. The sign of the magnetic moment is an indication of the N/S orientation of the magnetic field. By convention, a positive sign indicates a magnetic north vector while negative a magnetic south vector.

The H-3 nucleus 601 has two terminal down quarks 602 like the neutron so we might expect a negative magnetic moment, and yet the sign is positive. Similarly odd is the negative magnetic moment of He-3 603. Given its two terminal up quarks 604, one might assume a positive sign, just like the positive magnetic moment of the proton with its two terminal up quarks, and yet the magnetic moment is negative.

To understand the source of this odd sign reversal we must draw from the field of aeronautical engineering and rotary-powered airplane design. The propellers of an airplane having two engines must rotate in opposite directions to stabilize the aircraft. If the two propellers 901 and 903 rotate in the same direction then clockwise engine torque 909 will cause a counterclockwise torque 907 on the aircraft 905 as shown in FIG. 9.

FIG. 10 illustrates this point as it applies to the He-3 nucleus. The U-shaped He-3 nucleus has two terminal up quarks 604 moving in clockwise fashion producing a downward magnetic field as shown 610. But the clockwise rotation 613 of the up quarks applies a counterclockwise torque, resulting in counterclockwise rotation 611 of the He-3 nucleus. The center of positive charge of the two up quarks thus rotates in a counterclockwise direction 615 effectively reversing the sign of the magnetic moment! A similar mechanism applies to H-3.

The short list of magnetic moments in Table 1 indicate that the magnetic moment is independent of the atomic number for light nuclei, but stays within a small range. The same is true of more massive isotopes. Examples include 13C, 19F and 31P, each of which has an odd mass number. An odd mass number would preclude nucleon pairing within a closed loop, meaning these isotopes would have terminal quarks capable of precessing according to this model. Furthermore, these isotopes have magnetic moments as follows: 13Cμ=0.7022, 19Fμ=2.6273, and 31Pμ=1.1305, all within the range of the light nuclei. This implies a component of nuclear structure common to both the light nuclei and these heavier nuclei that is capable of imparting a magnetic moment. Terminal precessing quarks are a likely candidate. An alternating quark sequence not joined in a loop will always have two terminal quarks regardless of the length of the sequence. This data suggests that the precession of terminal quarks may play a large role in determining the magnetic moment.

The odd horseshoe shape of H-3 and He-3 derived from the RMS charge radii and magnetic moments implies that there is an attractive force between the terminal ends that maintains this horseshoe shape. The source of this attraction may be a dipole-dipole interaction as shown in FIG. 11.

Up to this point, up and down quarks have been depicted as stationary particles, but this depiction is meant to represent the center of charge only. It is understood that quarks are in constant motion (though the equations of motion are as yet unknown).

For the sake of illustration, a down quark 617 may be thought of as an up quark 619 that has captured an electron 621, as shown on the right side of FIG. 11. The negatively charged electron 621 functions as a linear oscillator 625 passing through the positively charged up quark 619 and moving between the two extremes shown on the right side of FIG. 11. The electrostatic force on the electron falls to zero as the electron approaches the center of the up quark, then momentum carries the electron through to the opposite extreme.

This oscillation is analogous to a hypothetical case in which there exists a hole through the earth between the U.S. and China. A stone dropped in the hole would accelerate towards the center of the earth, and then begin to decelerate on its path to the surface of China. It would pause for a moment in China before accelerating back towards the U.S. (neglecting frictional effects, and the rotation of the earth, of course), and continue oscillating between opposite surfaces of the planet.

Whereas the oscillation between the stone and earth arises from gravitational attraction, the oscillation of electron within down quark arises from the electrostatic attraction between negative electron 621 and positive up quark 619 as depicted on the right in FIG. 11. This creates an oscillating dipole 625. What's more, assuming all down quarks on H-3 oscillate in tandem, the two terminal down quark oscillating dipoles 623 and 624 always oscillate 180 degrees out of phase. These out of phase dipoles attract as shown by the pair of dotted lines 627 on the left of FIG. 11.

Typical chemical dipole-dipole interactions are not strong, disrupted constantly by molecular collisions. But the atomic nucleus is isolated, protected first by the surrounding electron cloud, and then by the Coulomb barrier nearer the nucleus. This means that the weak linkage created by dipole-dipole attraction between H-3 and He-3 terminal quarks would be free from disruption by outside influence.

Of course, the harmonic oscillation of an electron within a down quark does not only occur within terminal down quarks. This oscillating dipole would occur within internal down quarks as well. If the structure of larger nuclei is a folded loop as suggested above (FIG. 7, pane 705), the oscillating dipoles within one strand of the loop would serve to attract a neighboring strand. In the case where spaces or gaps exist between strands, the oscillating dipoles across the gap might attract the oscillating dipole of a neutron, forming a neutron ligand. This neutron ligand serves to stabilize the folded loop structure of the nucleus.

The horseshoe shape of H-3, with its down quarks harmonically oscillating in tandem, provides an ideal matrix for understanding beta decay in which a nucleus emits a highspeed electron while a neutron becomes a proton as shown in FIG. 12. In this mechanism, the electron 631 associated with the terminal down quark 633 on the left jumps to an adjacent up quark 635. This in turn displaces the electron from the next adjacent down quark 637, and this process continues until the final terminal down quark has ejected its electron 639 as beta decay. At this precise moment, H-3 becomes He-3. The atomic mass number remains the same because the number of nucleons remains the same, but there is now one more proton so the atomic number increases by one. Beta decay of H-3, or tritium, occurs with a half-life of 12.3 years.

The harmonic oscillation of electrons within down quarks is illustrated in greater detail in FIG. 13. Here the up quark is depicted as a toroid or donut, the electron a small sphere, and the down quark a sphere within a toroid (a combination of the first two). The proton quark resonant states shown at the top of FIG. 13 depict the central electron oscillating from an extreme position on the left to the extreme on the right. Similarly, the neutron quark resonant states contain two terminal down quarks with two electrons harmonically oscillating in tandem from the extreme on the left to the extreme on the right.

While the proton is extremely stable, having a half-life that exceeds the age of the universe, the neutron is unstable with a half-life of 10.5 minutes. The mechanism for the short half-life of the neutron, shown in FIG. 14, compared to the proton may involve the statistical possibility that a terminal down quark contains an electron that is labile (see Neutron quark resonant states, FIG. 13), therefore the terminal down quark might lose its electron should it oscillate too far. This imparts a certain lability to the terminal down quark electron. The stability of the proton lies in the internal down quark whose electron is protected by the terminal up quarks.

The degree of lability of a terminal down quark electron may well depend on how many electrons are linked by tandem harmonic oscillation. The labile electron in the neutron is linked to only one other down quark electron, and has a short half-life of 10.5 minutes. The labile terminal down quark electron of H-3, with its much longer half-life of 12.3 years, is linked to 4 other down quark electrons. Carbon-14 may be linked to 5 or 6 other down quark electrons harmonically oscillating in tandem, and C-14 has a beta-decay half-life of 5700 years.

Perhaps the most dramatic and unusual physical property of the atomic nucleus is the potential energy barrier, or Coulomb barrier, with its repulsion at a distance and strong attraction at near range. There is no common classical analog, and this behavior is generally outside human experience. Strange, too, is the notion of asymptotic freedom, the idea that as a pair of quarks (or nucleons) is pulled apart the force between them initially increases.

This physical property follows from an alternating sequence of quarks as shown in FIG. 15. Here the alternating sequence of up and down quarks contained within a proton and a neutron is superimposed on a deuteron. Immediately adjacent to the deuteron in the near-range, alternating quark charge creates an electric field that alternates +/−polarity.

In the far range, however, the electric field is predominantly positive. This arises from the unequal positive charge on the up quark which is twice the magnitude of the negative charge on the down quark. The consequence of the positive charge charge predominance is repulsion between a pair of deuterons at a distance as depicted in FIG. 16.

The same two deuterons are now placed immediately adjacent one another in FIG. 17. The pair are sufficiently close, and their quarks are aligned, so that the up quark on one is electrostatically attracted to the down quark on the other, resulting in a strong near-range attraction.

The alternating sequence of quarks within a deuteron can be modelled using a magnet analog. The up quark in FIG. 18 is shown as a double plus while the down quark a single minus. This is to represent that the +⅔ charge of the up quark is double the magnitude of the −¼ charge of the down quark. The double plus is modelled by a double North-facing magnet while the single minus is modelled by a single South-facing magnet on the magnet analog array.

In FIG. 19, the magnetic field emanating from a magnet array 645 models the electric field surrounding a deuteron 655. The alternating electric field 649 near the deuteron 655 is analogous to an alternating magnetic field 653 near the magnet array. In the far-range, however, the positive charge predominance resulting from the double charge on up quarks results in a far-range + charge predominance 647. Likewise, the double north-facing magnets (643) creates a north magnetic flux predominance 651 in the magnet array far range.

The forces between a pair of these magnet arrays will reproduce the fusion binding curve as the arrays are brought near together. The force of repulsion is barely detectable at a separation of 10 cm as shown in FIG. 20. This repulsive force rises to a maximum of 0.152 N in FIG. 21, after which repulsion gives way to strong attraction. The magnetic attraction between magnet arrays arises from the close proximity of the double North pole on one array to the single South pole on the other as shown on the right in FIG. 22. This is analogous to the attraction between oppositely charged quarks on two adjacent deuterons, as shown on the left.

FIG. 23 represents contour maps of magnetic fields between two magnet arrays set ⅜" apart 727 and 3" apart 725. Each white square with an arrow represents a cube magnet measuring ⅜" on a side. By convention, the arrow in each square points towards magnetic north and away from magnetic south. North magnetic flux is positive and lighter, while south flux is negative and darker.

Magnet array 719 in pane 723 is unopposed. The double north-facing magnets 715 produce a lighter shaded magnetic field of north magnetic flux 711 while the south-facing single magnets 717 produce the darker shaded south magnetic flux 713. Immediately adjacent magnet array 719 the magnetic field alternates north/south flux. A bit farther from the magnet array of pane 723, north magnetic flux 711 fills the pane. This pane is the experimental verification of the predicted magnetic field shown in FIGS. 15 and 19.

Pane 725 is an experimentally determined magnetic contour map of the magnetic field between a magnetic deuteron analog (magnet array 719) and a magnetic analog of a proton (magnet array 721). The magnet arrays repel one another just as we would expect a deuteron nucleus to repel a proton. The proton array 721 has a double north-facing magnet on either side of a single south-facing magnet. This arrangement is meant to model the −⅓ down quark sandwiched between two +⅔ up quarks. The magnetic contour map indicates that the predominant interaction between the magnet arrays is a sea of north magnetic flux (711), which indicates a pattern of repulsion.

Pane 727 positions the deuteron magnet array 719 at a distance ⅜" apart from the proton magnet array 721. The magnetic contour map at this near range demonstrates a pattern of attraction, as indicated by the dark fingers of south magnetic flux 713 extending and nearly touching the light concentric circles of north magnetic flux 715.

A similar pair of magnet arrays may also be used to demonstrate the concept of asymptotic freedom. In FIG. 24, the maximum force required to separate the magnet arrays is the same whether the arrays are pulled directly apart by applying a force normal to the arrays, or by apply a shear force which causes one array to slide away from the other at a right angle. The force/distance curves are quite different. The normal force generates a typical inverse square curve wherein the force of separation is initially highest, then falls away with the inverse of the square of the distance as the arrays separate further.

In contrast, when a shear force is applied to separate one array from the other, the force required to slide one array off the other is initially easy but becomes more difficult with increased displacement as shown in FIG. 25 on the left. The force/distance curve is linear, increasing to a maximum of 20.8 N. This linear curve is an illustration of asymptotic freedom.

Furthermore, if we divide the maximum attractive force FIG. 25 left (20.8 N) by the maximum repulsive force FIG. 25 right (0.152 N), the result very nearly approximates the strong force coupling constant of 137, as shown in the calculation in FIG. 25. This is the reciprocal of the fine structure constant, the number that the Nobel laureate Richard Feynman thought all physicists should "worry about".

The magnet array referenced in FIGS. 21 and 25 is a series of six double N-facing cube magnets, ¼" on a side, alternating with 6 single S-facing magnets. The N and S magnets are separated by a distance of ¼" so that the distance from the center of an N-facing magnet to its nearest S-facing neighbor is ½". Furthermore, the S-facing magnets are recessed ¼" relative to the N-facing magnets. So while other geometries and other ratios of N to S magnets may yield a magnetic potential barrier, it is this specific geometry that most closely yields the 137 ratio of attraction to repulsion, i.e., the distance between neighboring opposite poles being twice the depth to which the lesser pole is recessed AND the N pole having twice the pull force of the S pole.

FIG. 26 models nucleon binding energy and saturation using a loop of linked magnets. Nucleon binding energy is the energy required to remove a single nucleon from an atomic nucleus, as shown in the inset. The curve rises sharply before leveling off (saturating) at higher mass numbers, indicating a constant binding energy. The saturation shows that there is a fixed number of interactions per nucleon, indicating each nucleon is attracted only to its nearest neighbors. If each nucleon interacted with every other nucleon, the total number of interactions for each nucleon would equal the total number of nucleons minus one (A−1). The binding energy per nucleon would then be proportional to A−1 rather than constant.

A nearest neighbor only attraction (and saturation curve) are demonstrated using a sequence of linked magnets arranged in a loop 671. This loop of magnets is intended as an analog to an alternating sequence of quarks arranged in a loop, such as the proposed structure of He-4 in FIGS. 4 and 6. The magnets are magnetized diametrically in FIG. 27, and the direction of magnetic north is shown by the arrow atop each squat cylinder magnet 671. The diametric orientation of N/S poles allows the cylinders to attract only one nearest neighbor on either side. The force required to remove one magnet from a loop of magnets is graphed on the right, and is meant as an analog to the energy required to remove one nucleon from a nucleus (the nucleon binding energy). After 8 magnets or so, the force required to separate one magnet from the rest levels off. The initial sharp rise and subsequent leveling off (saturation) of the magnet loop curve in FIG. 26 emulates the nucleon binding energy curve as depicted in the inset.

DESCRIPTION OF THE INVENTION

At this point in the history of science, there is no way to directly measure structure or geometric relationship between quarks within a nucleon. Technical and theoretical challenges place quark structure beyond the current limits of direct detection or measurement.

Models provide a means of exploring nuclear structure, and most models are mathematical. Described herein is a magnetic model of the atomic nucleus.

An alternating and unequal array of north- and south-facing magnets produces a magnetic potential barrier. When two such arrays are position opposite one another, the arrays will repel each other beyond a distance equivalent to the distance between two nearest like poles, and will attract within a distance equivalent to the distance between two neighboring opposite poles.

An embodiment of a permanent magnet potential energy barrier assembly has two opposing magnet arrays, each attached to its own frame. The magnet arrays are constructed using permanent magnets that alternate in north/south polarity.

Prior to assembling the magnet arrays, the pull-force of each magnet is measured. This may be achieved by allowing the magnet to couple with a standard piece of iron, then measuring the force required to pull the magnet away from the iron.

In order to create a magnetic potential barrier, the sum total of the pull forces of one polarity must be greater than the opposite polarity. This can be achieved by doubling the number of north-facing magnets compared to south-facing magnets. One way to achieve this is to stack two north-facing magnets, and attach this double north magnet couple to a frame, then adding an adjacent single south facing magnet. Alternating the magnets in this way produces an alternating magnetic field right next to the magnet array while at the same time creating a predominantly north flux magnetic field at farther distances.

A permanent magnet potential energy barrier assembly may have two such arrays opposing one another. When the pair of arrays face each other at a distance, they repel. When brought close together, however, the arrays attract. The magnets within each array can be spaced apart at varying distances to achieve stronger or weaker potential barriers. Likewise, one polarity of magnets may be recessed relative to the other polarity. This also affects the magnitude of the near-range attraction and far-range repulsion.

The alternating magnets on each opposing array of a permanent magnet potential energy barrier assembly may be attached to a frame that is linear, circular, triangular, or any other geometric configuration. Each frame may be attached to its own shaft to allow free rotation, and this shaft may be attached to a motor. Both frames may be attached to the same shaft, and a bearing may be incorporated to reduce friction between the frames and shaft.

DETAILED DESCRIPTION OF THE DRAWINGS

Figure 1:
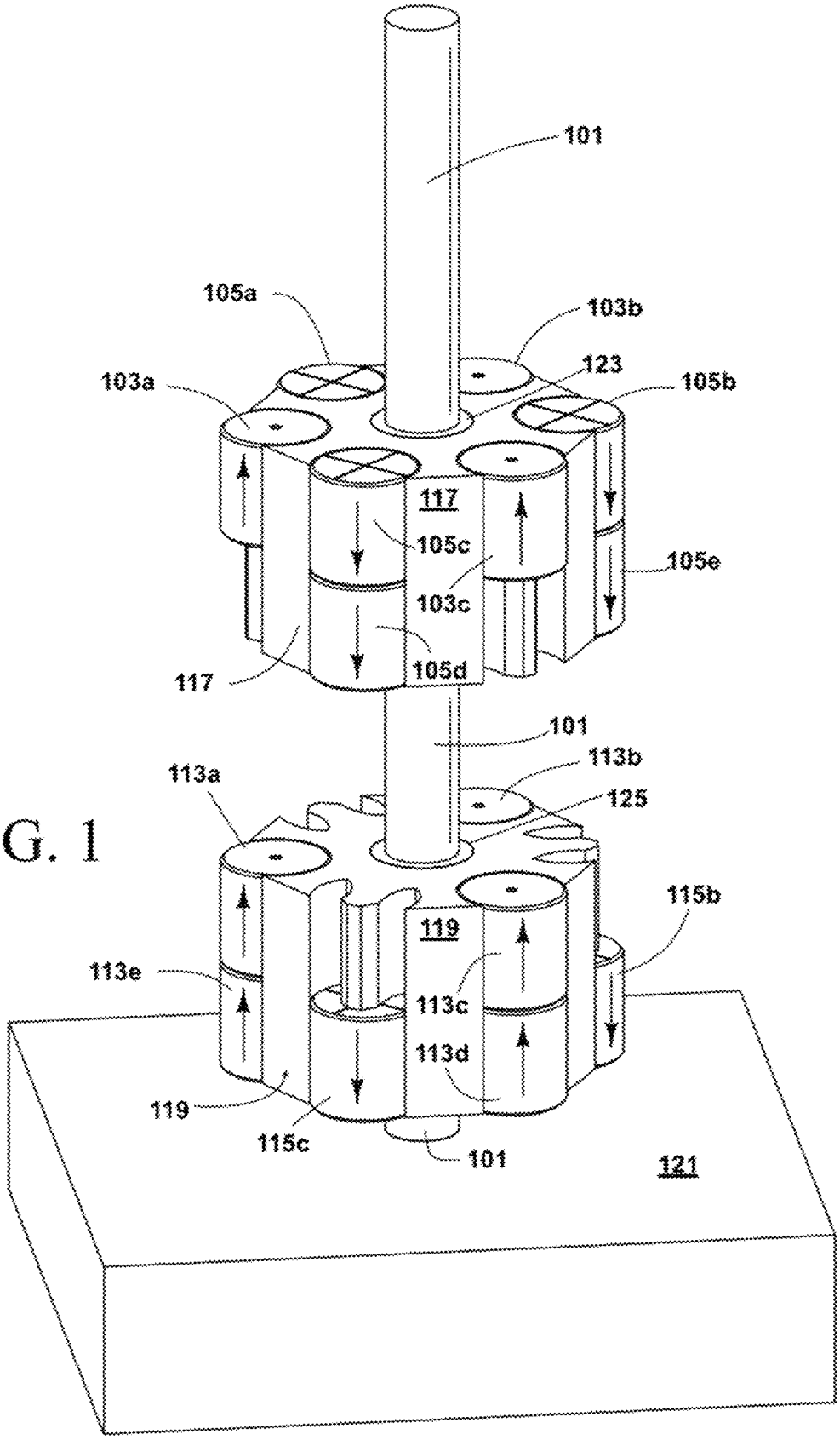
FIG. 1 is a perspective view of an embodiment of a permanent magnet potential energy barrier.

FIG. 1 is a perspective drawing of one embodiment of a permanent magnet potential energy barrier assembly in which magnet array 117, attached rotatably by bearing 123 to shaft 101 secured to base 121, magnetically levitates above magnet array 119. Magnet array 117 has stacked double magnets 105*c* and 105*d* attached to a frame (shown between the magnets) so that their north pole directed towards magnet array 119 while single magnet 103*c* is recessed relative to magnet 105*d*, and has its south pole oriented towards magnet array 119. The double north magnet will have approximately double the pull force of the single south magnet. This pattern continues around the cylindrical array 117, which may also be a disc. The net result of the predominance of north magnets facing downward is that the sum of the pull forces of north and south magnets yields a north magnetic pole predominance oriented in a downward direction.

Similarly, cylindrical magnet array 119 has an identical magnet configuration, except the north magnetic flux predominance is directed upward towards cylindrical array 117. The force of repulsion between these arrays effectively suspends or magnetically levitates magnet array 117 above magnet array 119.

Figure 2:
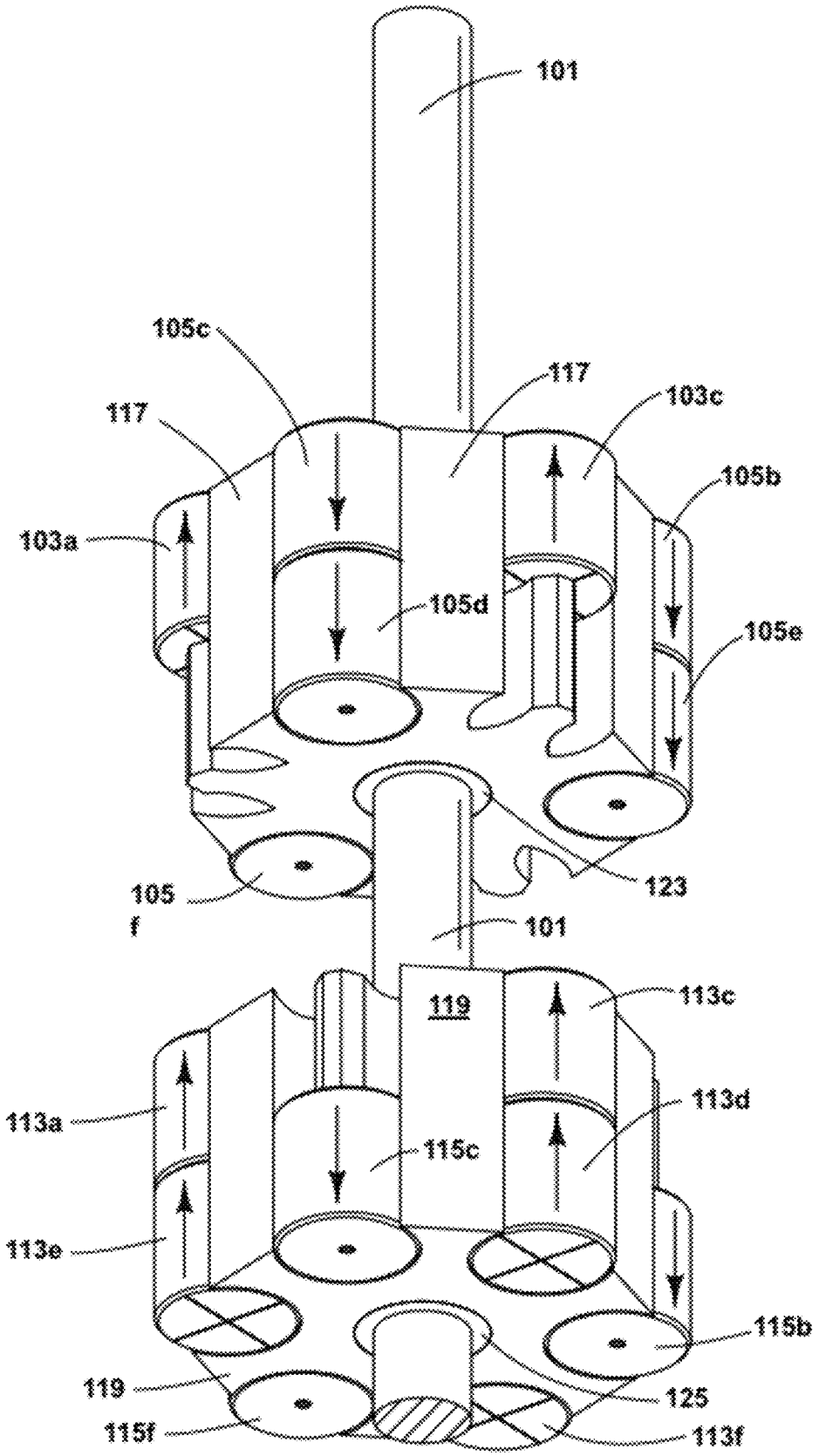
FIG. 2 is a perspective view of a permanent magnet potential energy barrier assembly.

FIG. 2 is a view from the underside of the magnetic potential energy assembly described in FIG. 1. This view serves to expose magnets hidden by the perspective view of FIG. 1 in order to confirm the magnet pattern in which a double north magnet alternates with a single south magnet, and the two arrays are configured so that the north magnetic flux of one is oriented towards the other.

Figure 3:
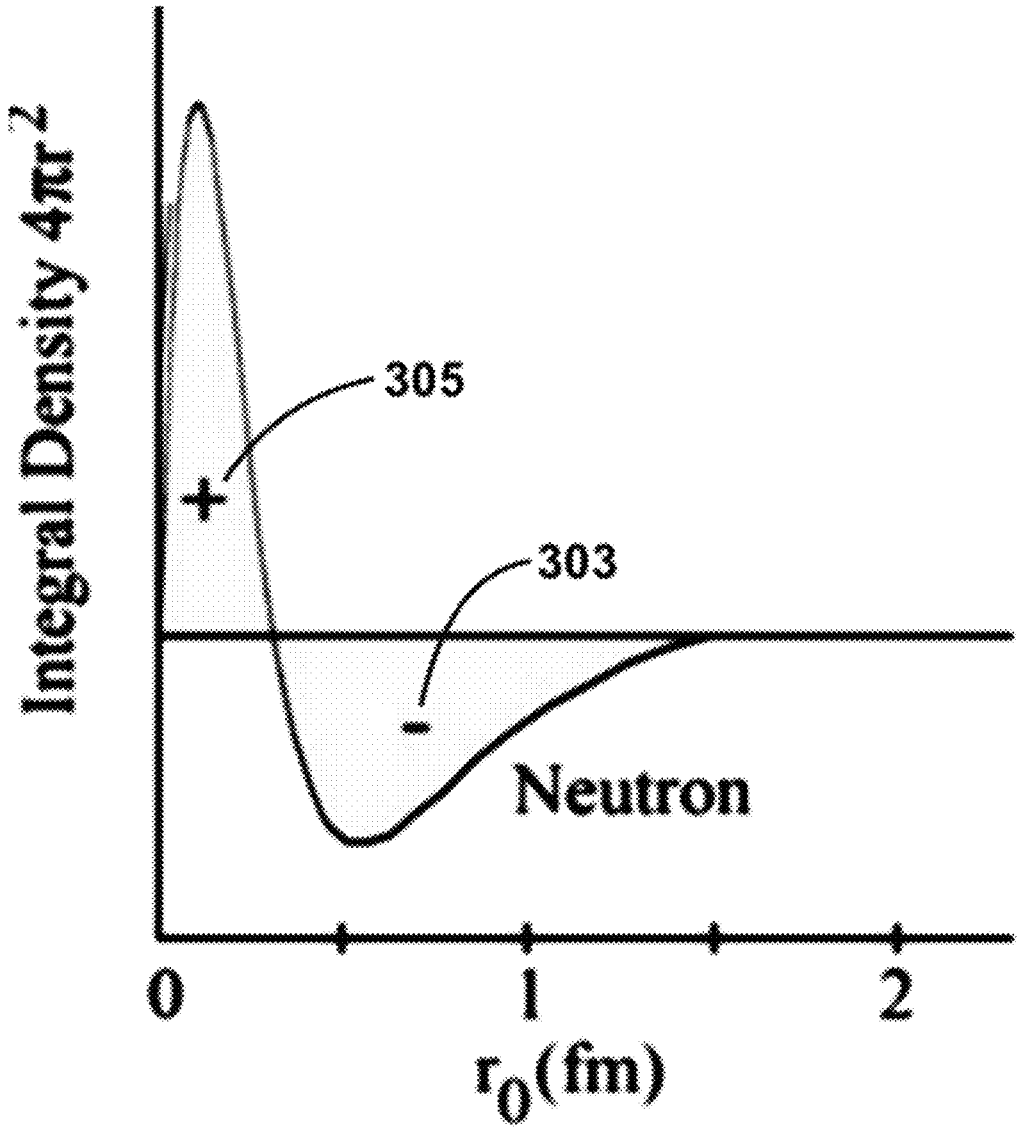
FIG. 3 is a neutron charge density diagram.

FIG. 3 shows the charge density of a neutron. A positive core 305 lies interior to a negative shell 303.

Figure 4:
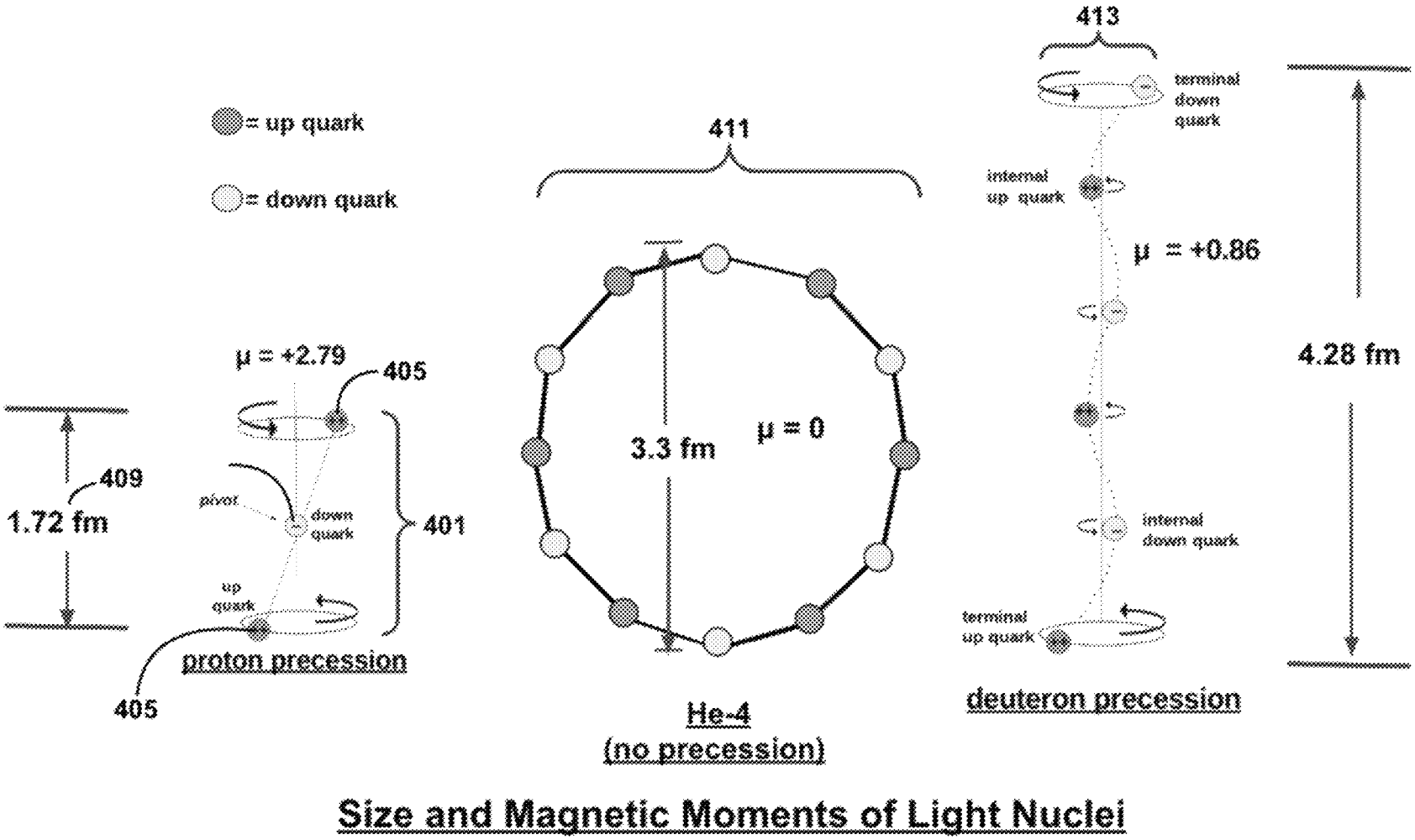
FIG. 4 shows the size and magnetic moments of light nuclei.

FIG. 4 depicts a proposed alternating quark structure for the light nuclei including proton 401, deuteron 413 and helium-4 411. The terminal quarks 405 of a proton allow for precession about a central pivot quark. The terminal quarks of the deuteron likewise precess, as do the internal quarks. The quarks of He-4, however, are bound within a circular structure and therefore do not precess.

Figure 5:
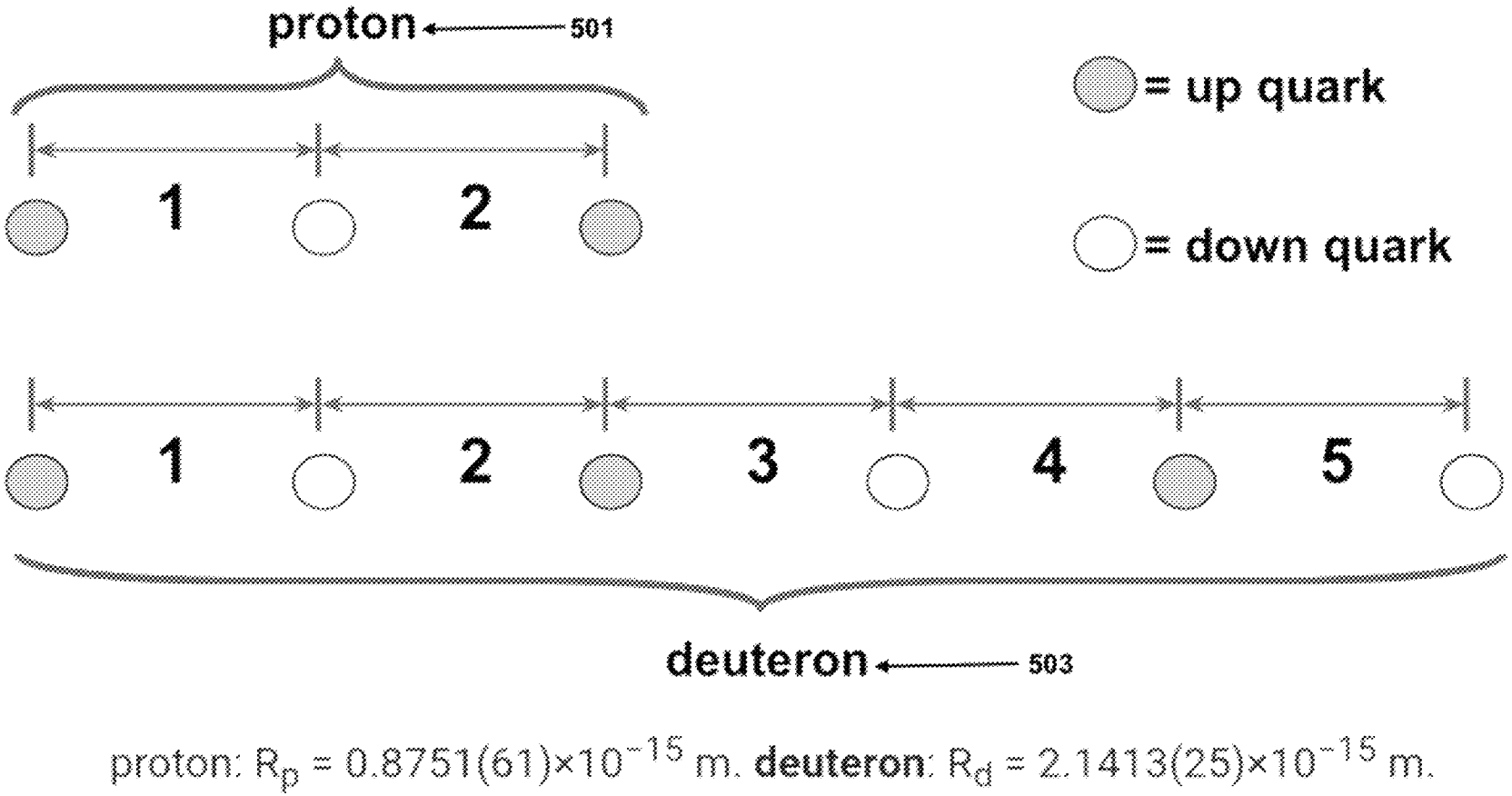
FIG. 5 shows the proton and deuteron.

FIG. 5 is a size comparison of a proposed linear sequential quark model of the proton and deuteron by which the deuteron ought to be 5/2 larger than the proton.

Figure 6:
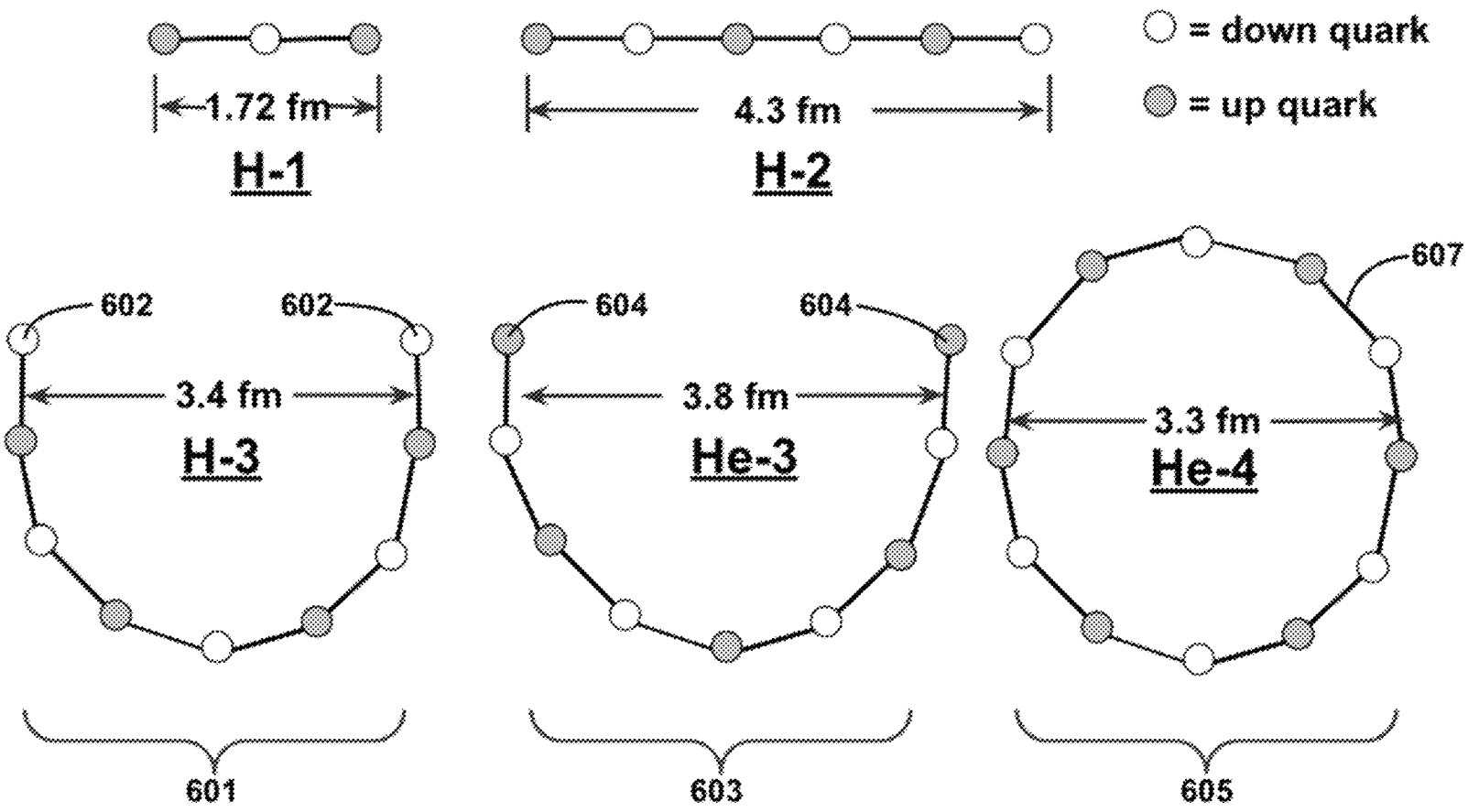
FIG. 6 compares the sizes and shapes of light nuclei.

FIG. 6 extends this size comparison to include H-3 and He-3, both of which may assume a horseshoe shape. The open topside of these structures explains the slightly large RMS charge radii of H-3 and He-3 compared to the closed loop of He-4.

Figure 7:
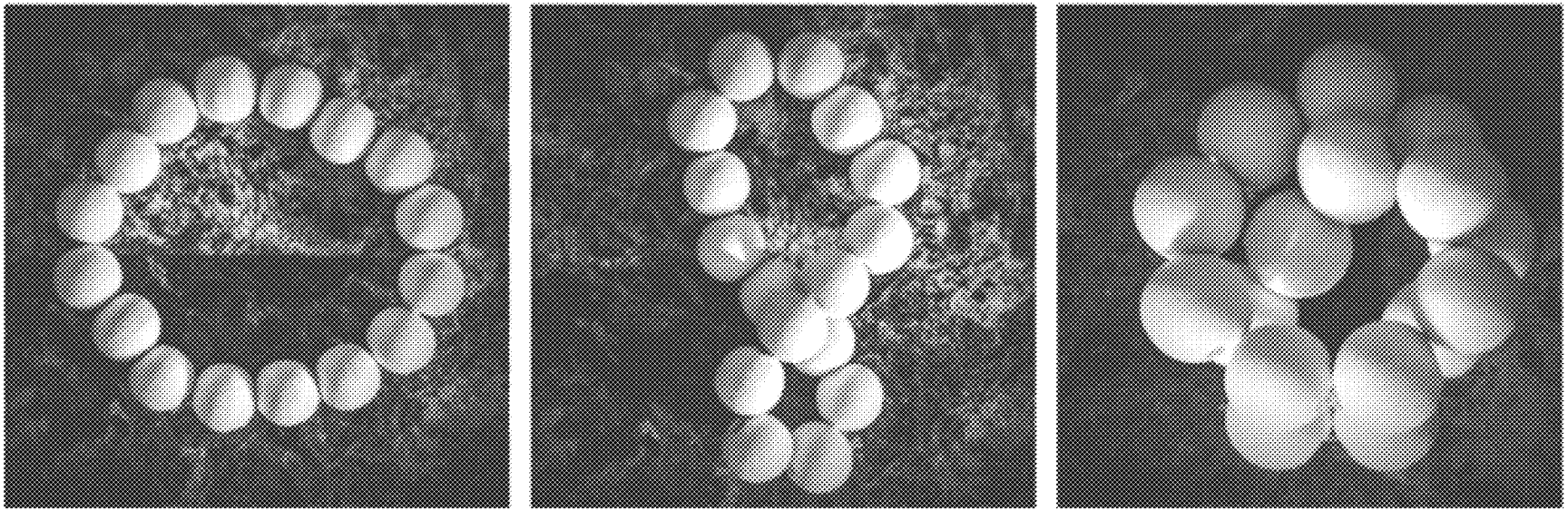
FIG. 7 shows three photos depicting a ring model of oxygen.

FIG. 7 introduces a loop structure for oxygen in which each bead represents a nucleon. Pane 701 shows the loop splayed open, pane 703 shows a single twist, and pane 705 shows the twist further folded to form a dense nucleus with a space in the middle.

Figure 8:
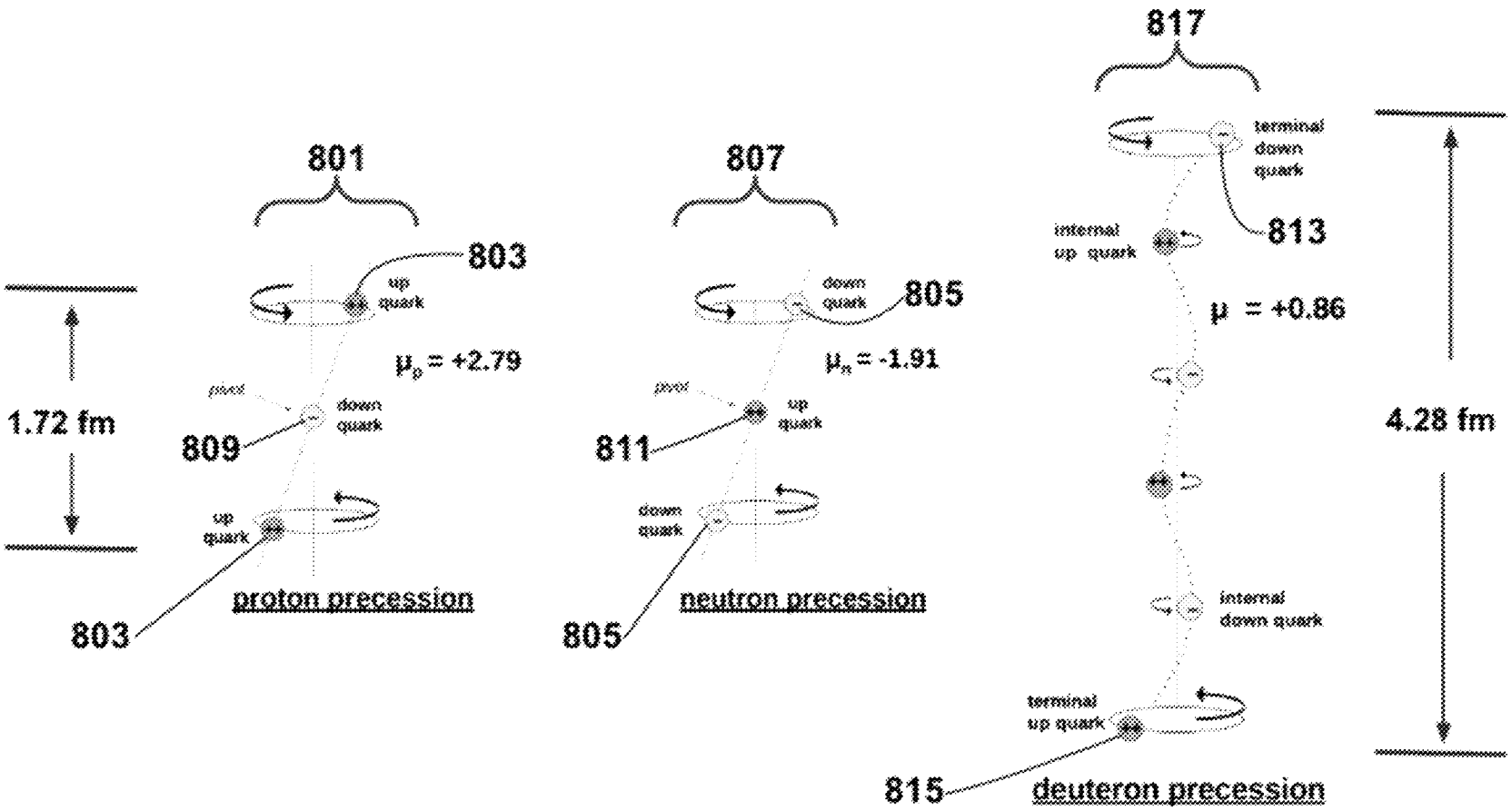
FIG. 8 shows the precession of the proton, neutron, and deuteron.

FIG. 8 revisits the Larmor precession of the proton and deuteron, and includes the neutron. The precessional motion of terminal quarks 803, 805, and 815 contribute to the magnetic moments of each of these nuclei.

Figure 9:
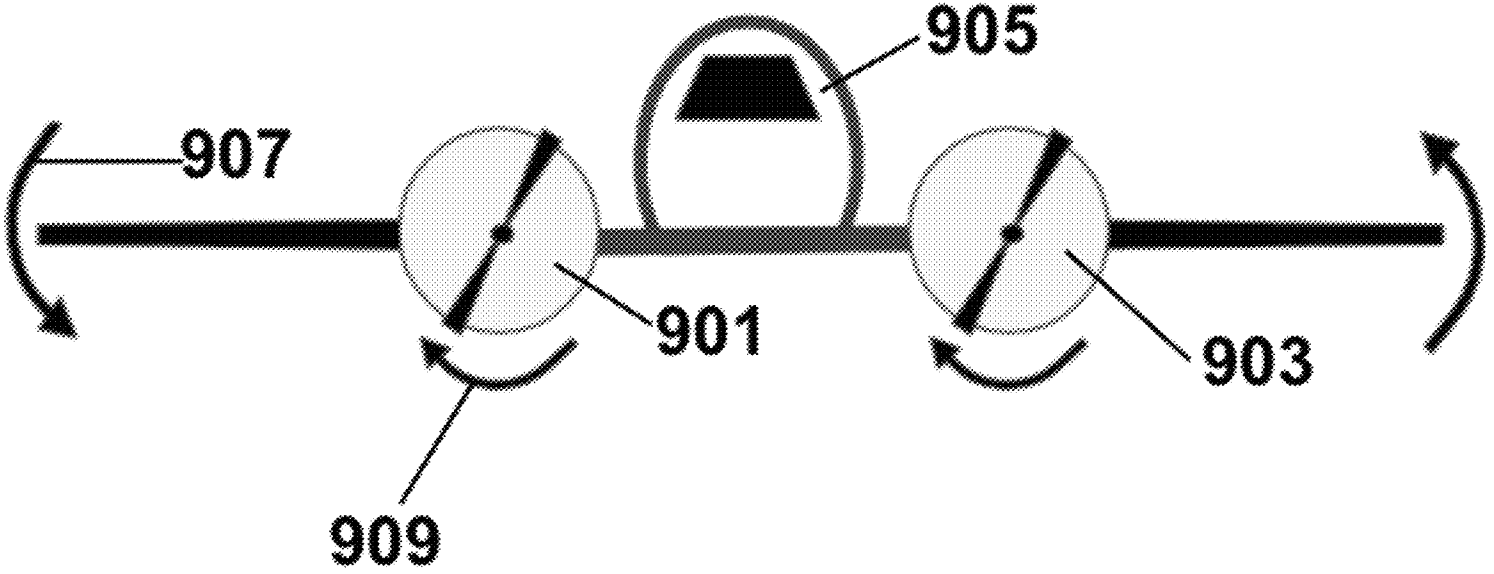
FIG. 9 shows an airplane with two propellers.

FIG. 9 illustrates the concept of torque/countertorque in a hypothetical airplane having two propellers. The clockwise torque 909 of the propellers 901 and 903 would result in the counterclockwise torque 907 on airplane 905.

Figure 10:
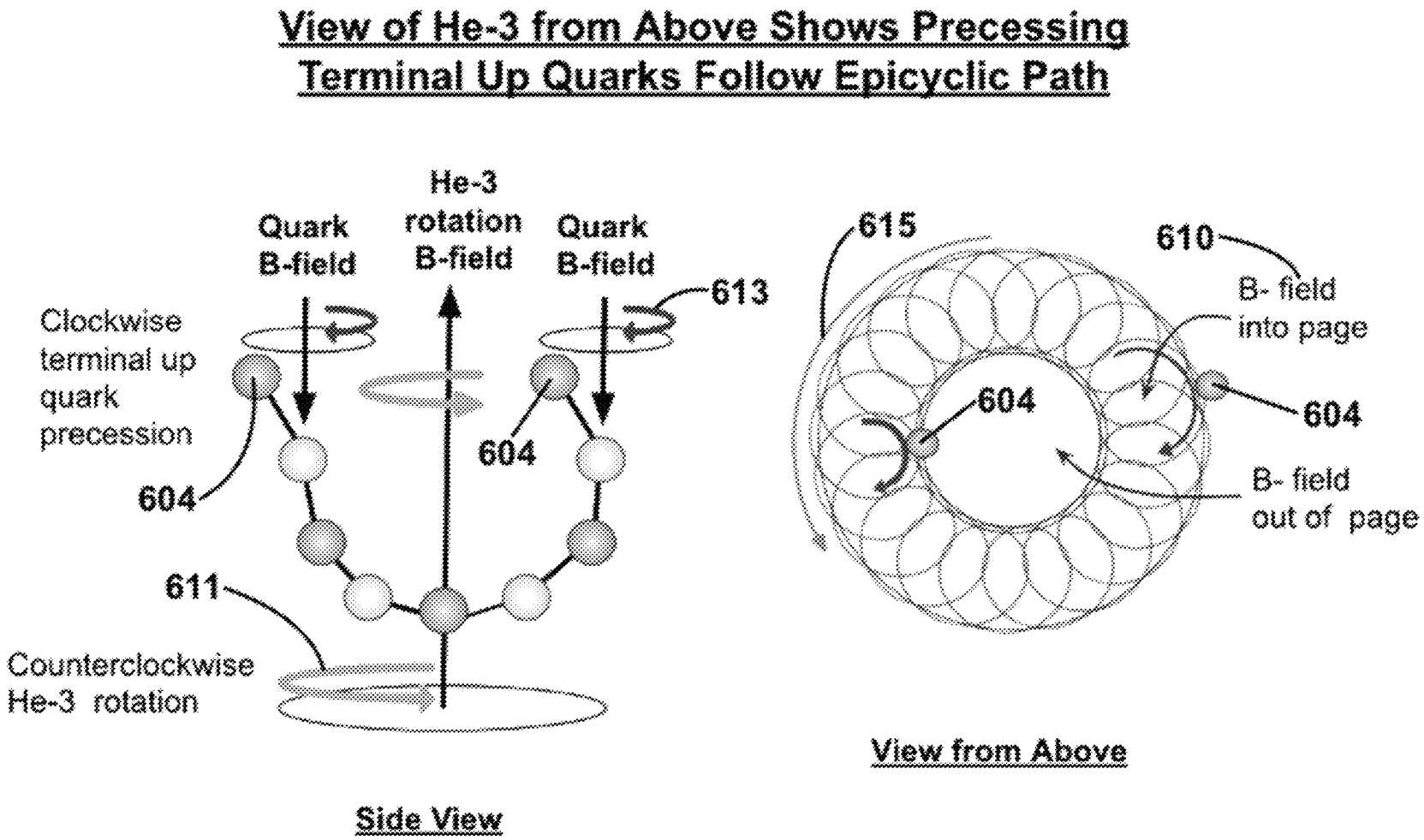
FIG. 10 shows the precession of He-3.

FIG. 10 serves as a model for the counterintuitive magnetic moment of He-3. The horseshoe shape and dual precessing terminal quarks 604 in a clockwise fashion 613 exert a force on the He-3 nucleus that results in counterclockwise rotation 611. While the clockwise torque of terminal quarks 604 generate a magnetic field that goes into the page (as viewed from above), the center of charge for this rotating quarks actually rotates in counterclockwise direction 615, which generates a magnetic field coming out of the page.

Figure 11:
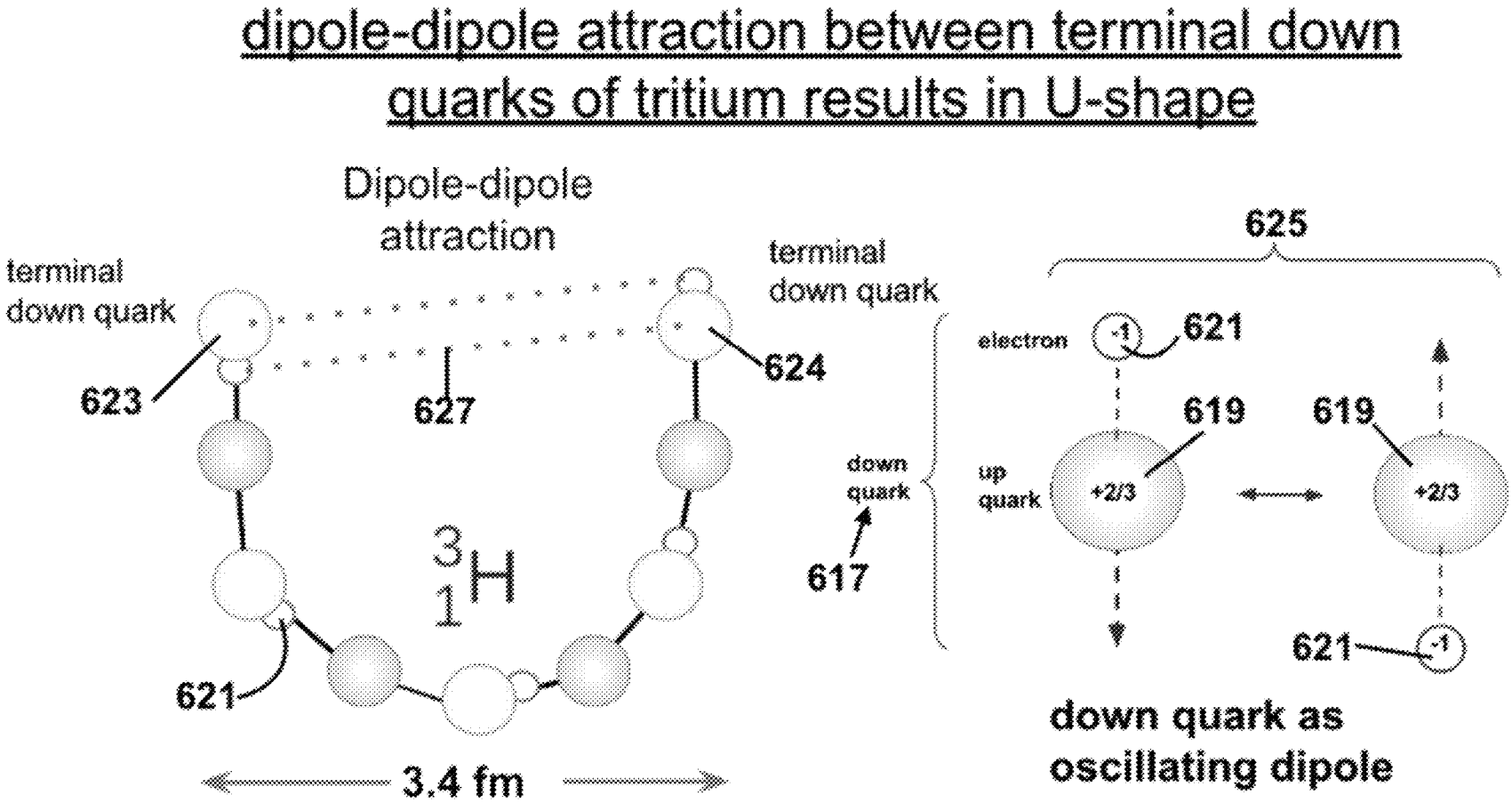
FIG. 11 shows the oscillating dipoles of H-3.

FIG. 11 illustrates the rational for the horseshoe shape of H-1. The terminal quarks 623 and 624 exhibit dipole-dipole attraction 627. Oscillating dipole 625 results from the attraction between the positively charged up quark and a negatively charged electron, forming a linear oscillator. The down quark 617 in this scenario represents an up quark 619 that has captured an electron 621.

Figure 12:
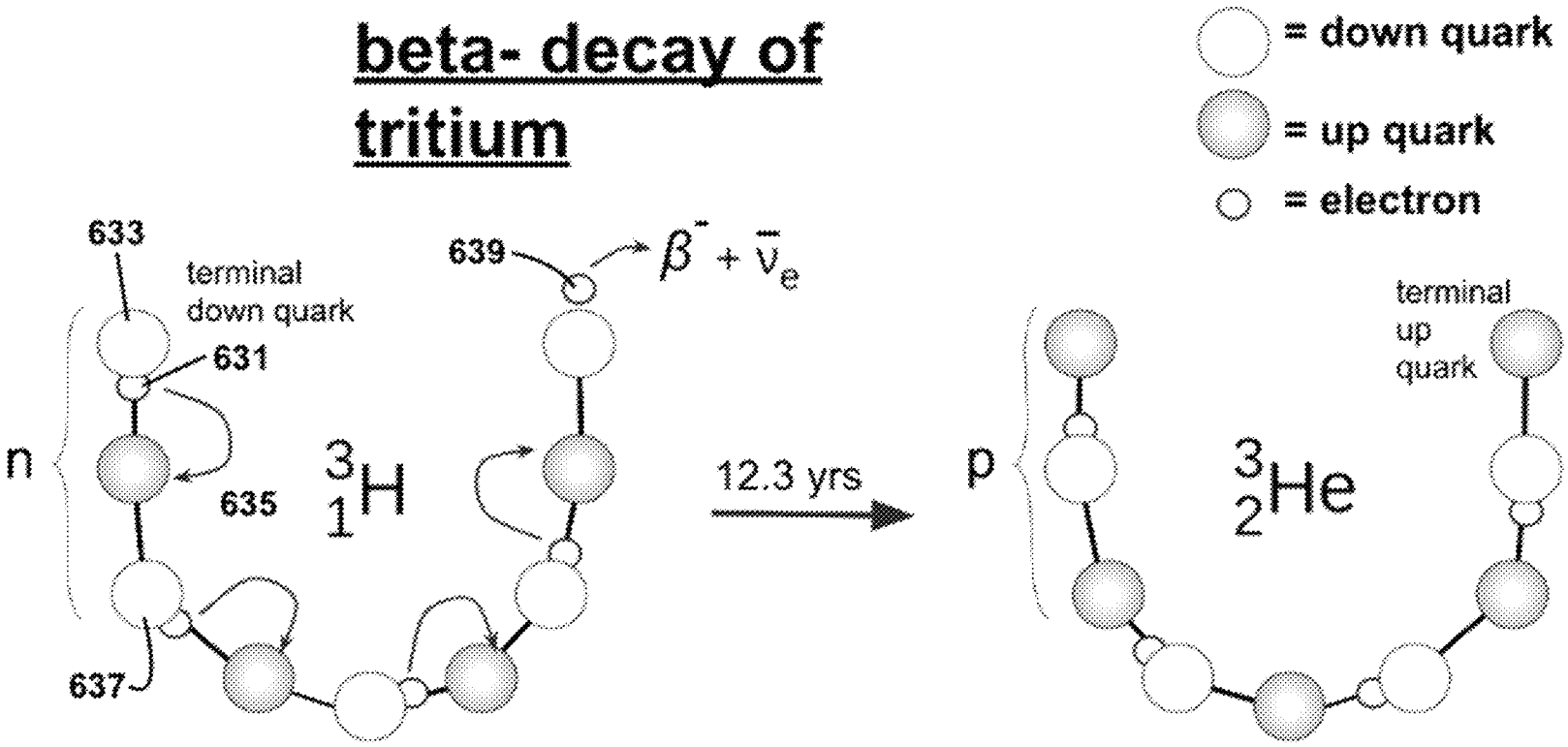
FIG. 12 is a mechanism for the beta decay of H-3 to He-3.

The structure outlined in FIG. 12 also provides insight into the phenomenon of the beta decay of tritium. H-1 has a pair of terminal down quarks 633. Occasionally and with a half-life of 12.3 years, a terminal down quark will lose hold of its electron, precipitating a cascade of electron movement throughout the chain in which the electron of a down quark is transferred to a neighboring up quark. This beta decay transforms H-3 into He-3.

Figure 13:
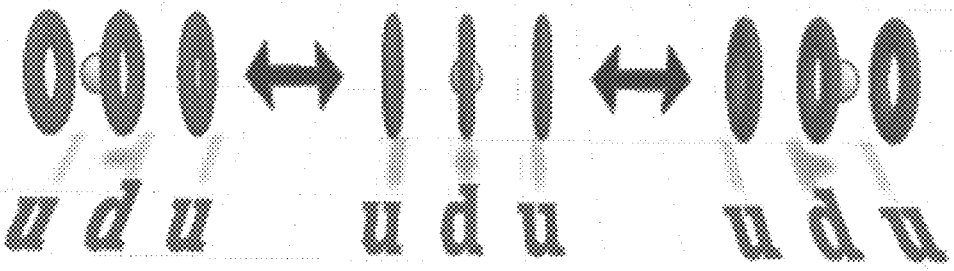
FIG. 13 shows the resonant states of a proton and neutron.
Figure 13:
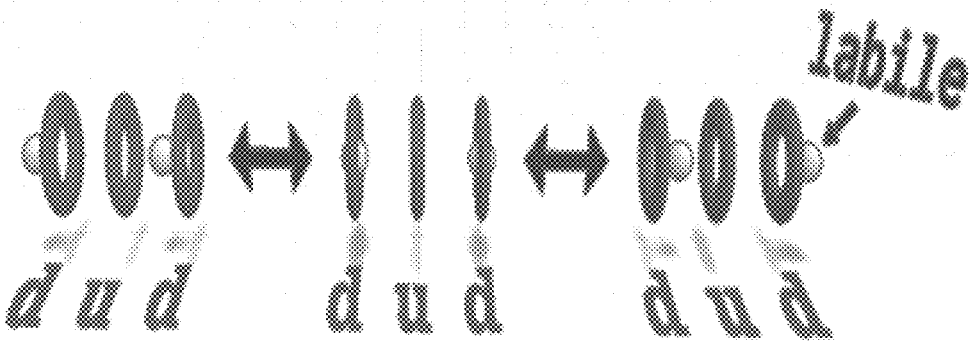
Figure 13:
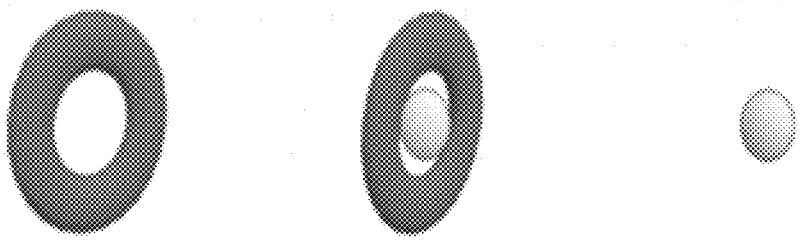

FIG. 13 shows another way to depict up and down quarks, wherein the up quark is a donut or toroid shape while the electron is smaller and spherical. The down quark is an up quark with an electron oscillating in the donut hole. Resonant states of the proton and neutron are shown.

Figure 14:
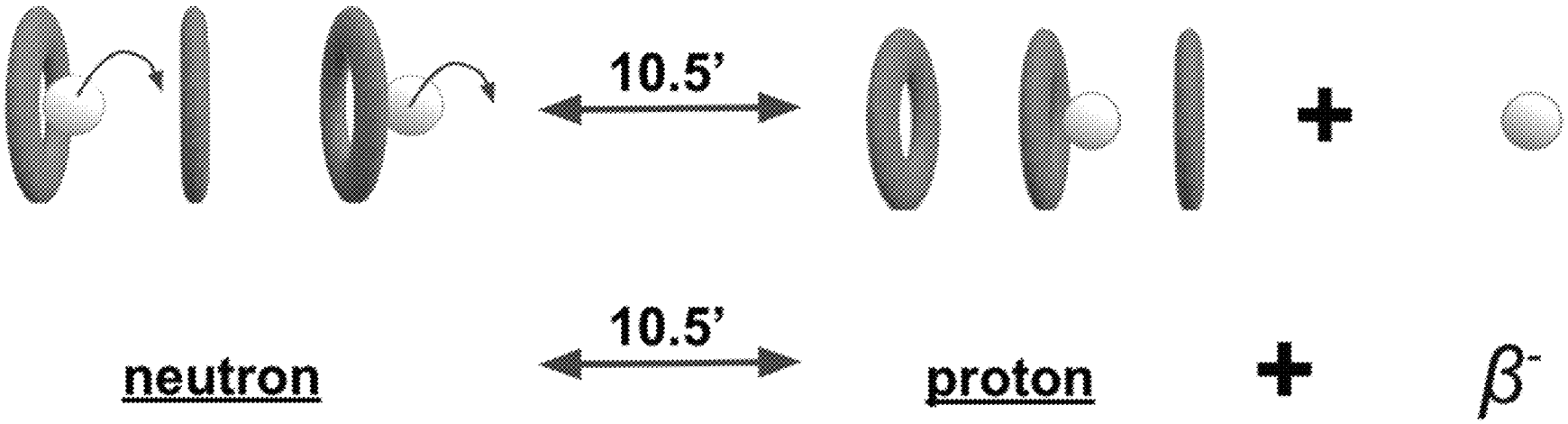
FIG. 14 shows the beta decay of a neutron into a proton.

FIG. 14 depicts the beta decay a neutron into a proton using the donut model. The random oscillation of the two electrons of the neutron occasionally results in the loss of one of the electrons as beta decay. The remaining electron shifts to the up quark at the center of the neutron, transforming it into a down quark, and transforming the neutron into a proton.

Figure 15:
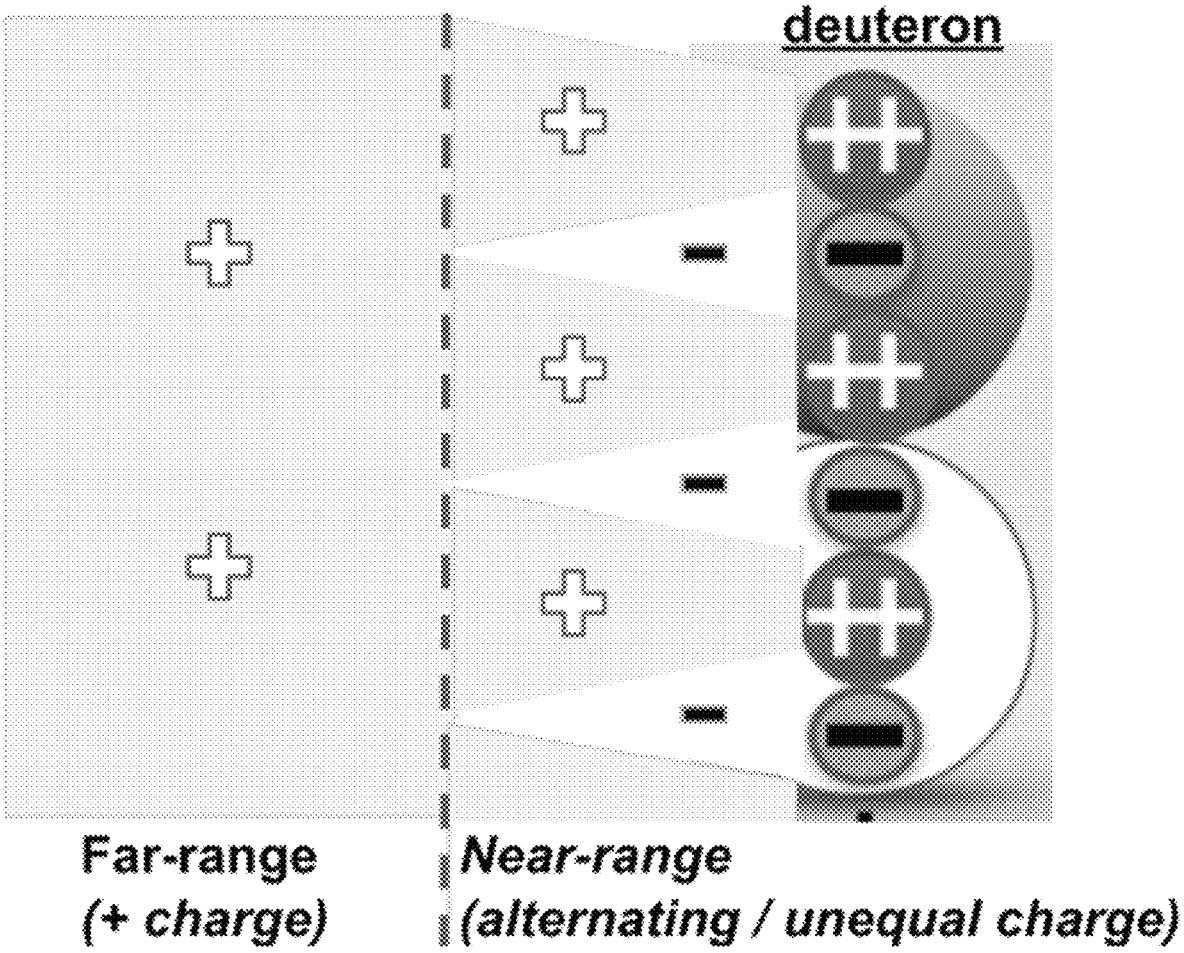
FIG. 15 shows the electric fields adjacent a deuteron.

FIG. 15 places a linear sequential arrangement of up quarks (++) alternating with down quarks (−). This produces a near range electrostatic field of alternating charge. The double charge of the up quark relative to the down quark results in a far-range positively charged electric field.

Figure 16:
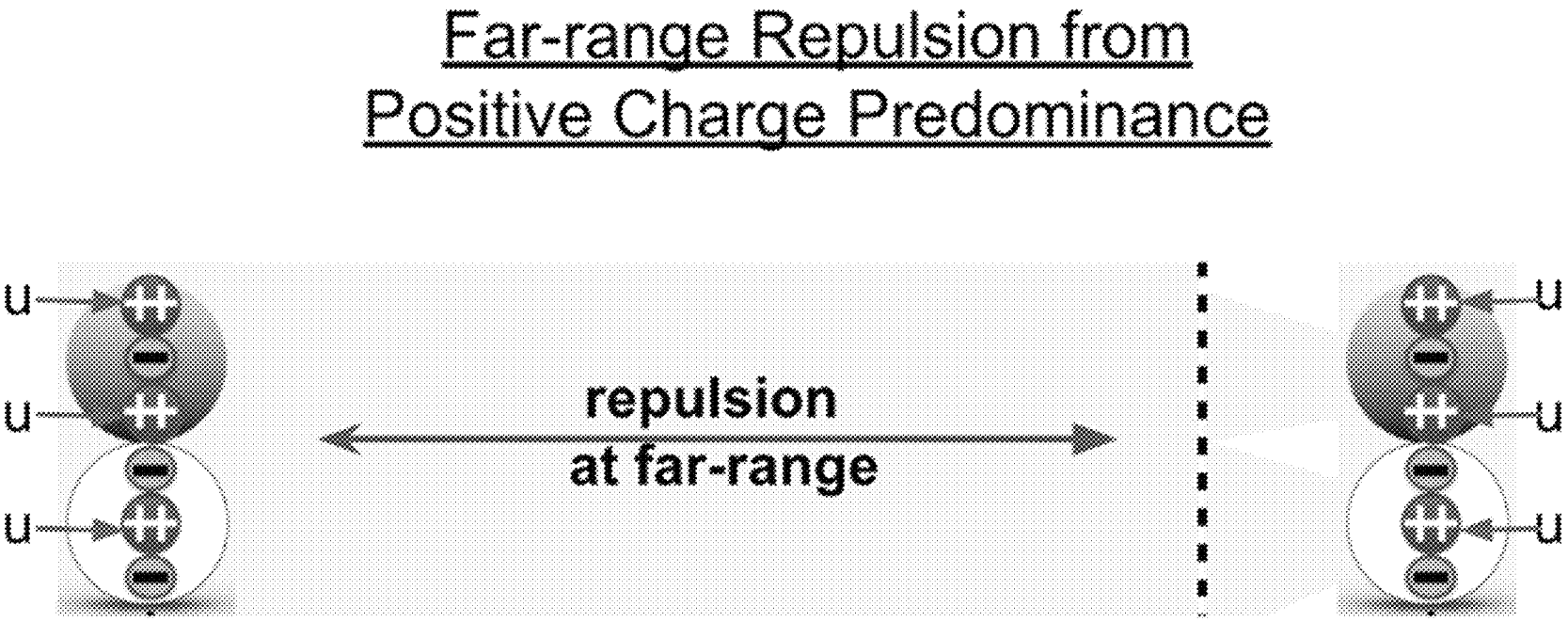
FIG. 16 shows the repulsion of two deuterons at far range.

FIG. 16 shows two deuterons repelling at a distance as a result of the positive charge predominance of up quarks.

Figure 17:
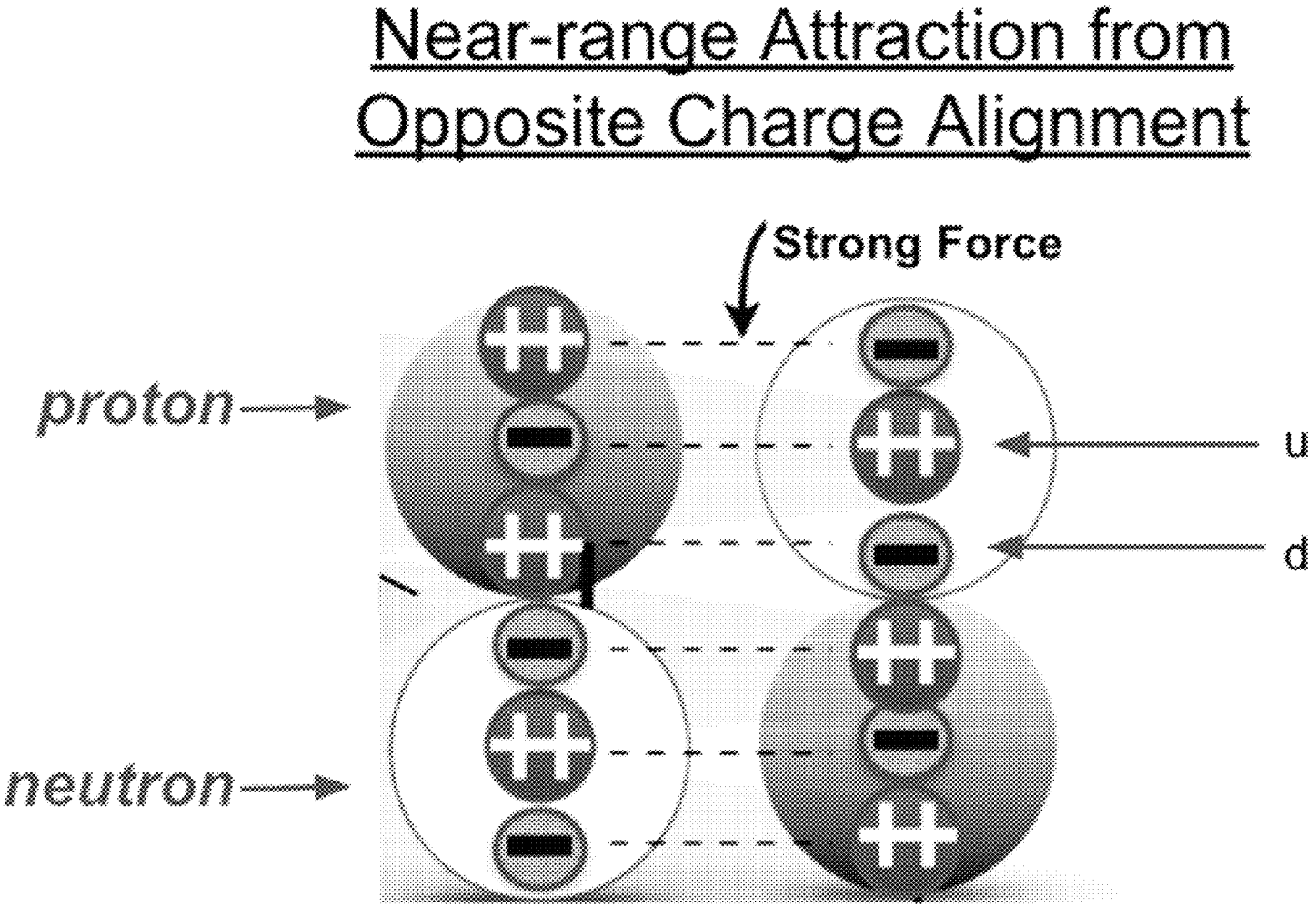
FIG. 17 shows the attraction of two deuterons at near range.

FIG. 17 shows the same two deuterons attracting in the near-range as a result of the alignment of oppositely charged quarks. This near-range attraction may represent the strong nuclear force.

Figure 18:
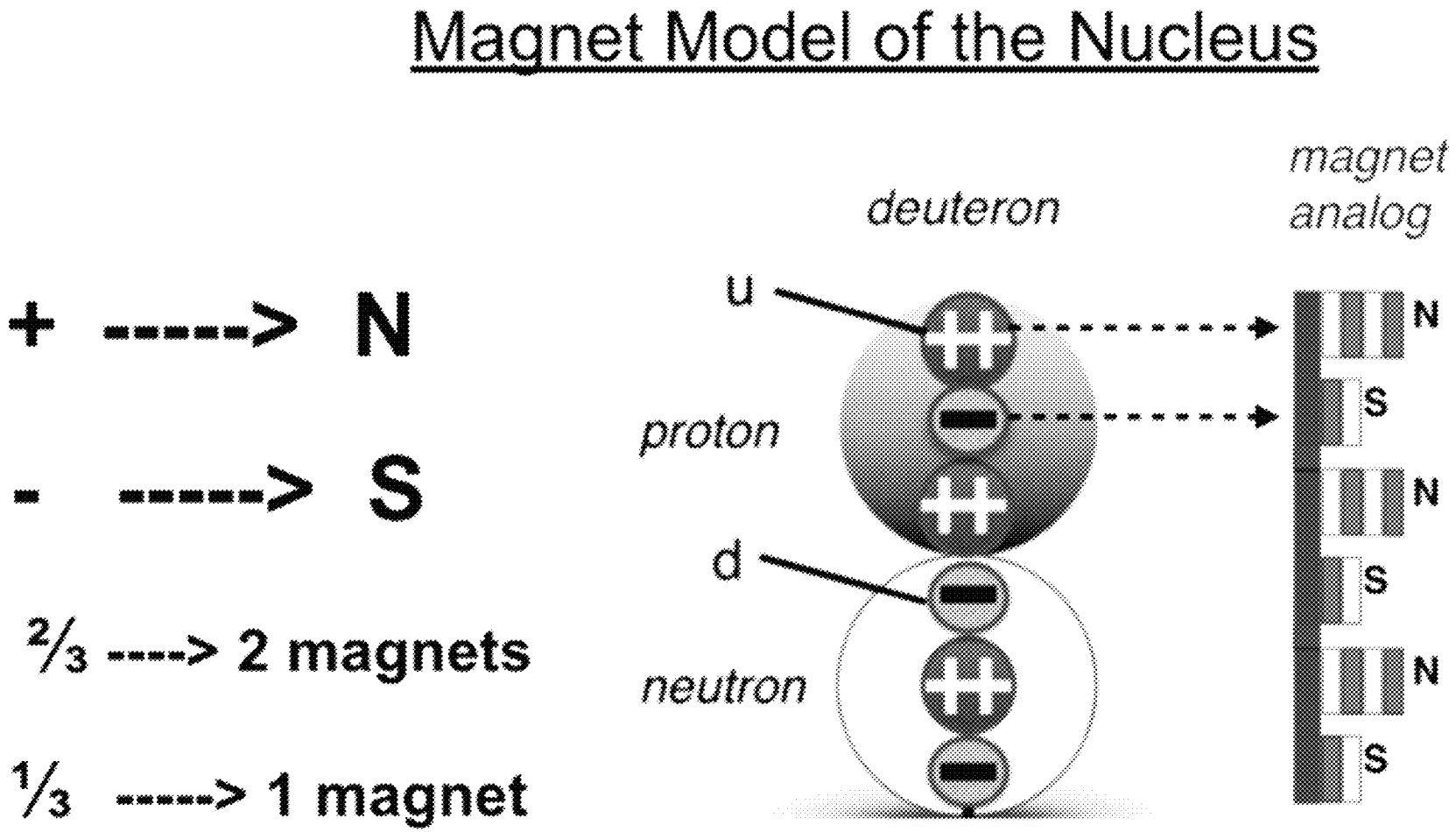
FIG. 18 shows a magnet analog of a deuteron.

FIG. 18 demonstrates how a magnet analog is constructed based on a linear alternating sequence of up and down quarks contained within the deuteron. Here, the double charge on the up quark compared to the down quark is represented by a doubling up of north facing magnets. The down quark is represented by a single south-facing magnet.

Figure 19:
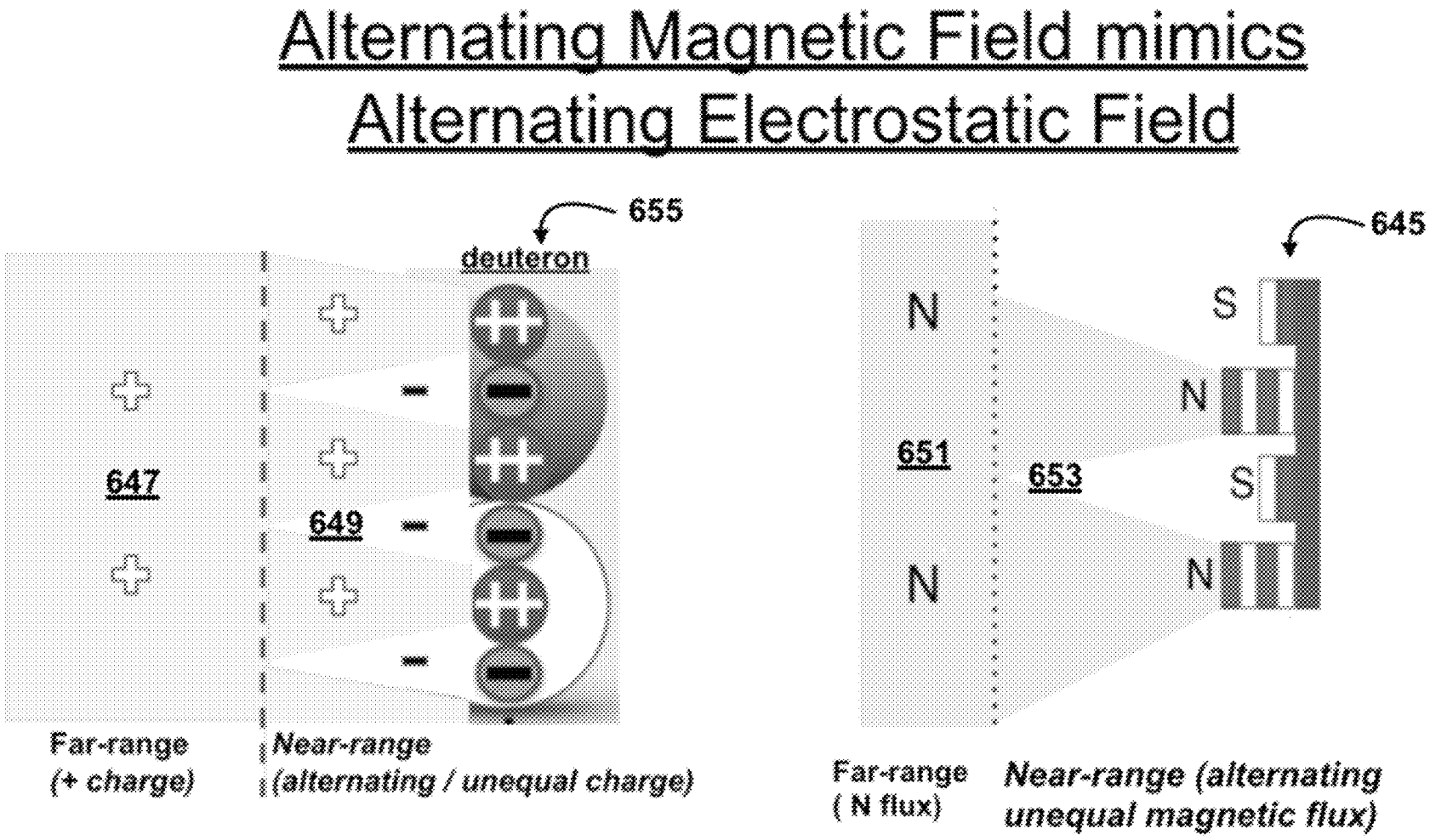
FIG. 19 shows the electric field of a deuteron and the magnetic field of a magnet array.

FIG. 19 shows how an alternating and unequal magnet analog generates a magnetic field that is hypothetically similar to the electric field surrounding a deuteron. Both have an alternating electromagnetic field in the near-range that resolves into a single field at a distance depending on pole predominance.

Figure 20:
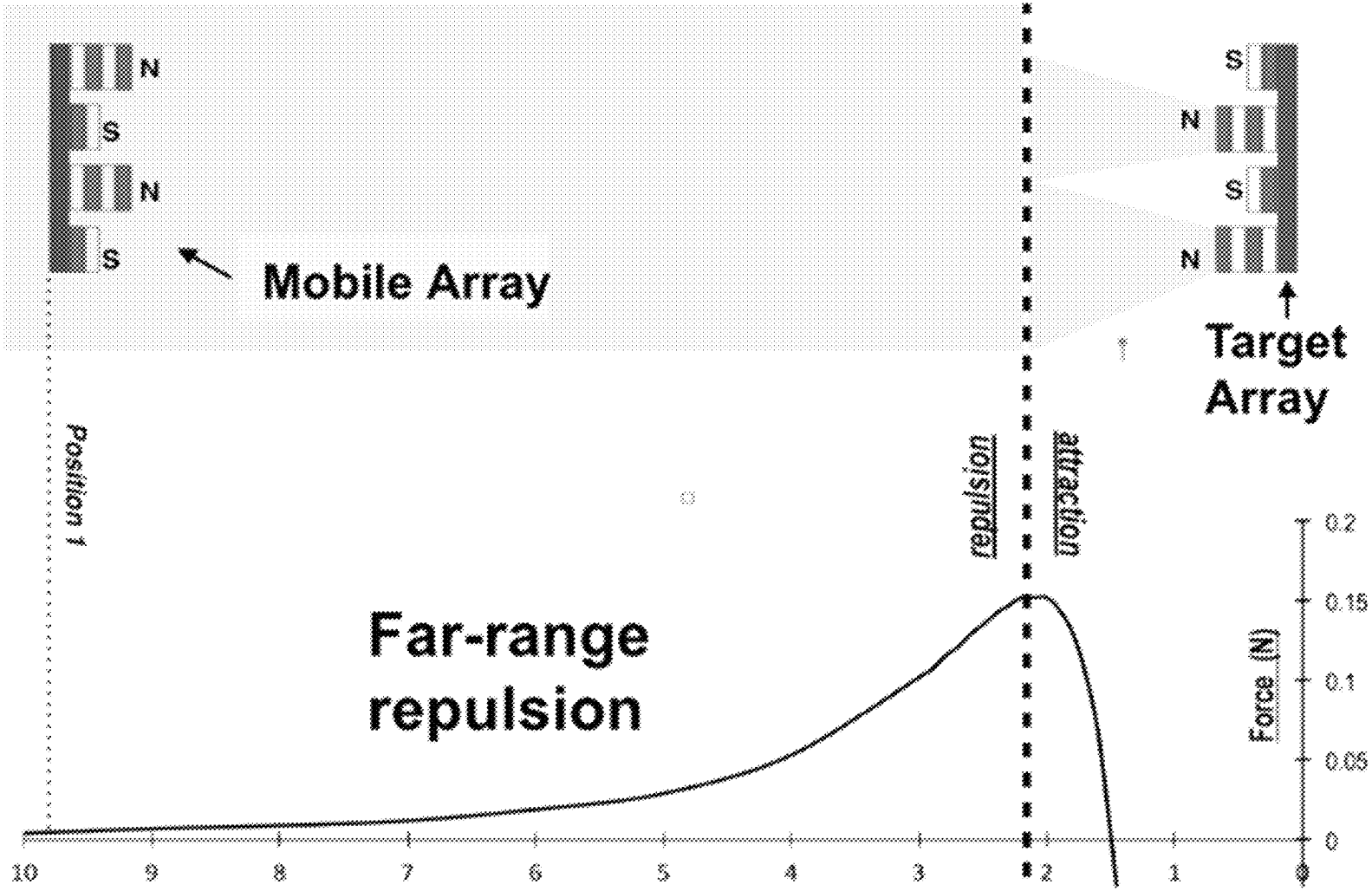
FIG. 20 shows how a pair of magnet arrays reproduces the fusion binding curve.

FIG. 20 demonstrates how a pair of magnet array analogs may be used to generate a potential curve very similar to the fusion potential curve.

Figure 21:
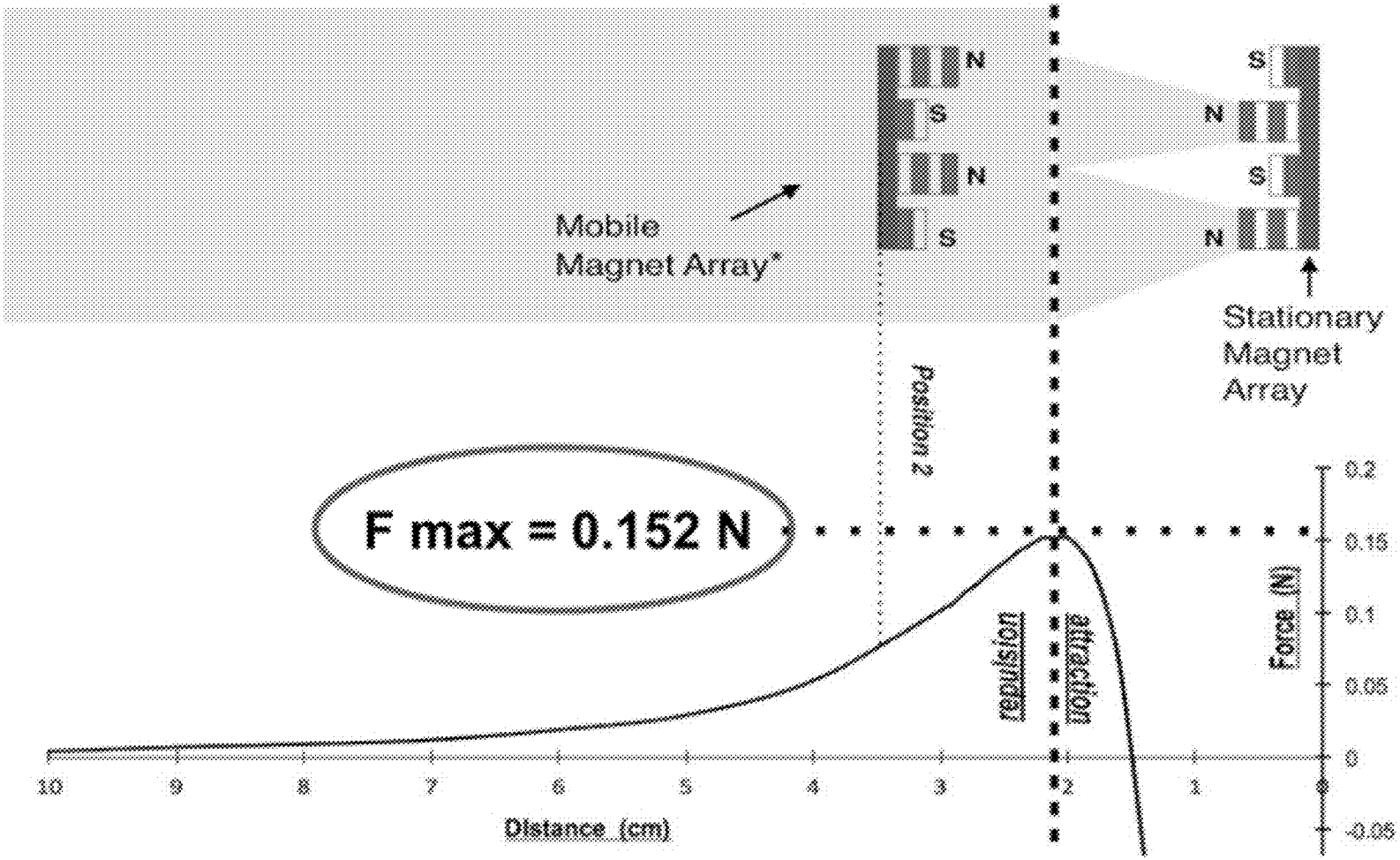
FIG. 21 shows the maximum repulsion between two magnet arrays.

FIG. 21 shows how the force between two approaching magnet arrays increases as the arrays approach. When a pair of arrays is constructed using cube magnets measuring a quarter inch on a side, alternating one south with a double north, set apart with a ¼" space between north and south magnets, and arranged so that the south face is ¼" recessed relative to the north face, a maximum repulsive force of 0.152 N was obtained.

Figure 22:
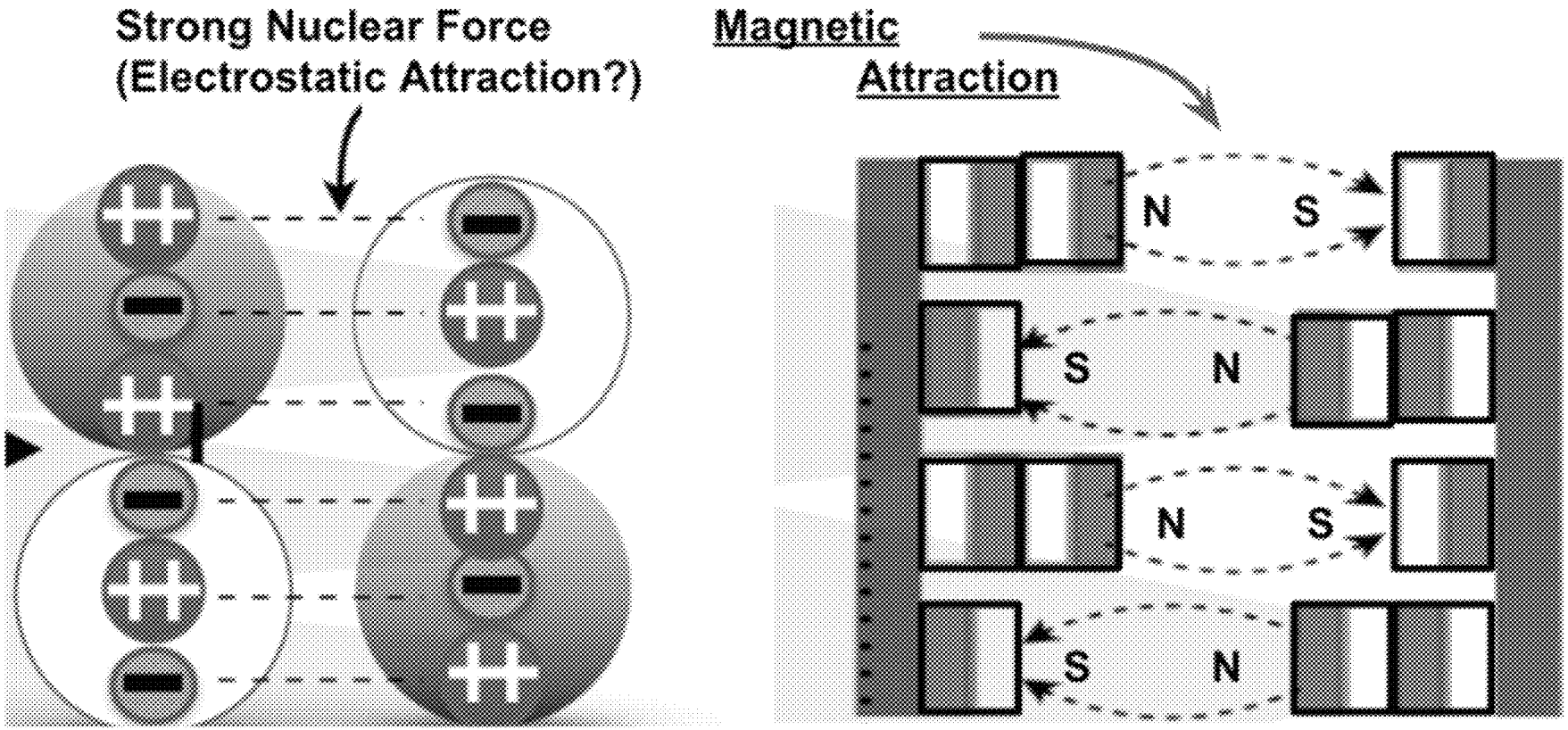
FIG. 22 shows the near-range attraction of a pair of deuterons and a pair of magnets.

FIG. 22 compares the strong attraction that would exist between deuterons with the strong attraction between a pair of magnet array analogs.

Figure 23:
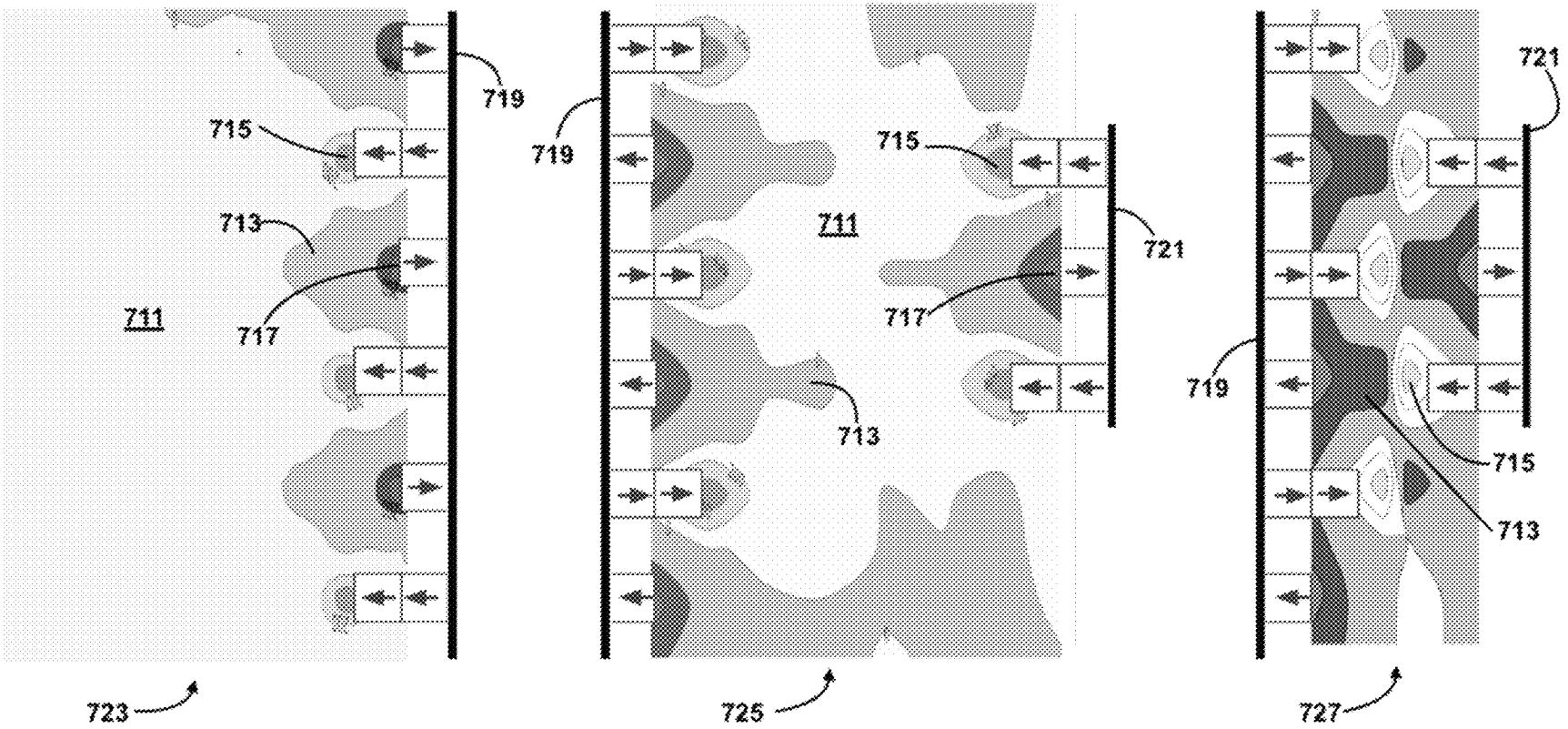
FIG. 23 is a magnet field contour plot between two arrays at two distances.

FIG. 23 has three magnetic contour maps generated from a matrix of magnetic field measurements between magnet arrays. Pane 723 shows the magnetic field contour plot of an unopposed magnet array intended to model deuteron 719. The white squares with arrows represent cube magnets measuring ⅜" on a side, and the arrow represents the direction of magnetic north. Double north magnets alternate with single south magnets with a separation of ⅜" between north and south magnets, and configured such that the south magnet face is ⅜" recessed relative to the north magnet faces. In pane 723, the light shaded north magnetic flux 711 emanates from the double north magnets 715, and predominates over most of the pane. The darker south magnetic flux 713 extends only a bit beyond the south magnets 717.

In pane 725, a deuteron magnet analog 719 is set opposite a proton magnet analog 721 by a distance of 3". North magnetic flux 711 predominates in the field between the arrays, indicating repulsion at this distance.

The deuteron 719 and proton 721 analogs are set ⅜" apart in pane 727. Note the dark finger of south magnetic flux 713 extend and almost touching the lighter center of north magnetic flux 715. This pattern represents strong interaction between opposite poles, the steep contours indicating strong attraction.

Figure 24:
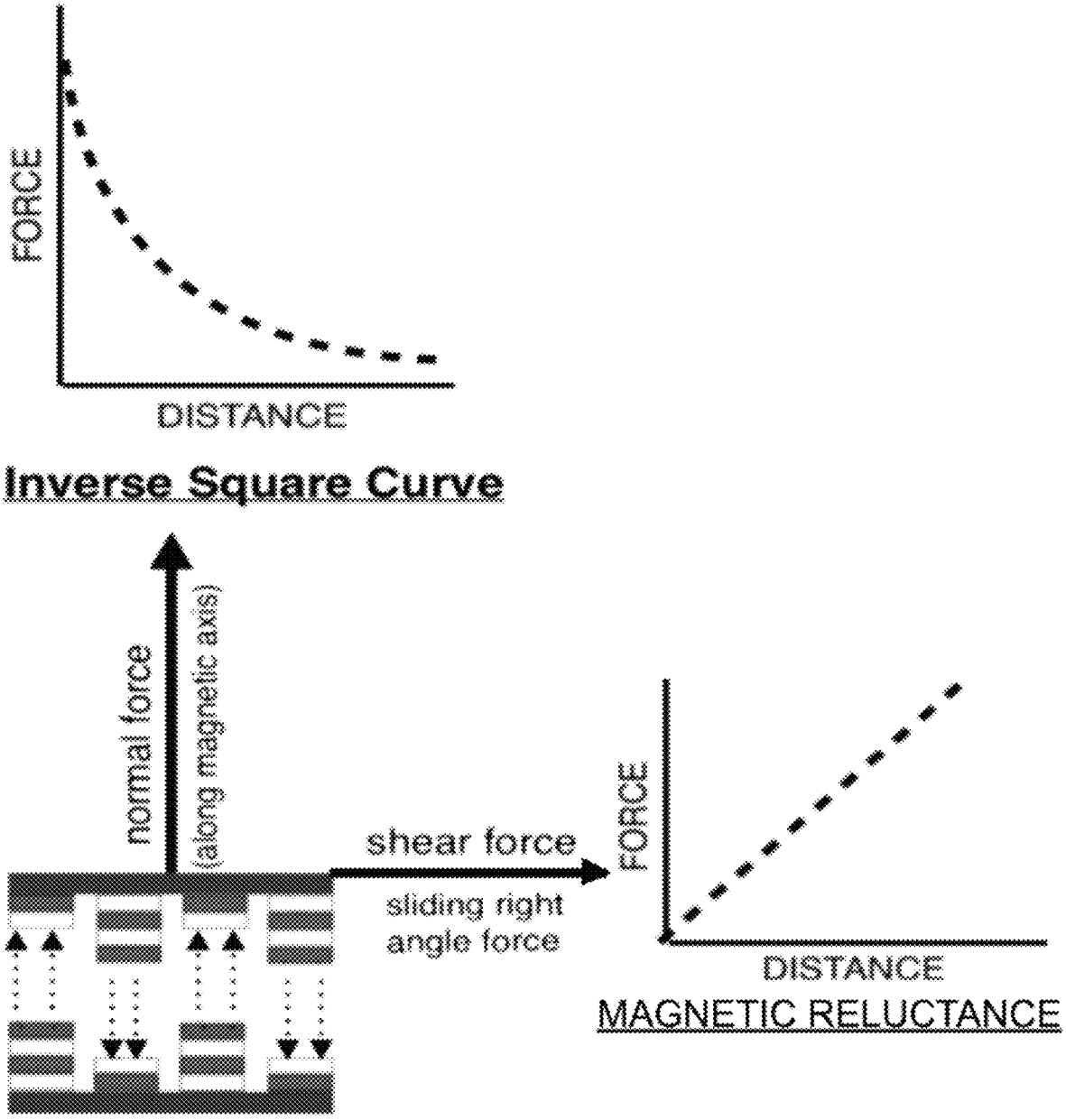
FIG. 24 shows forces acting on a magnet array.
Figure 25:
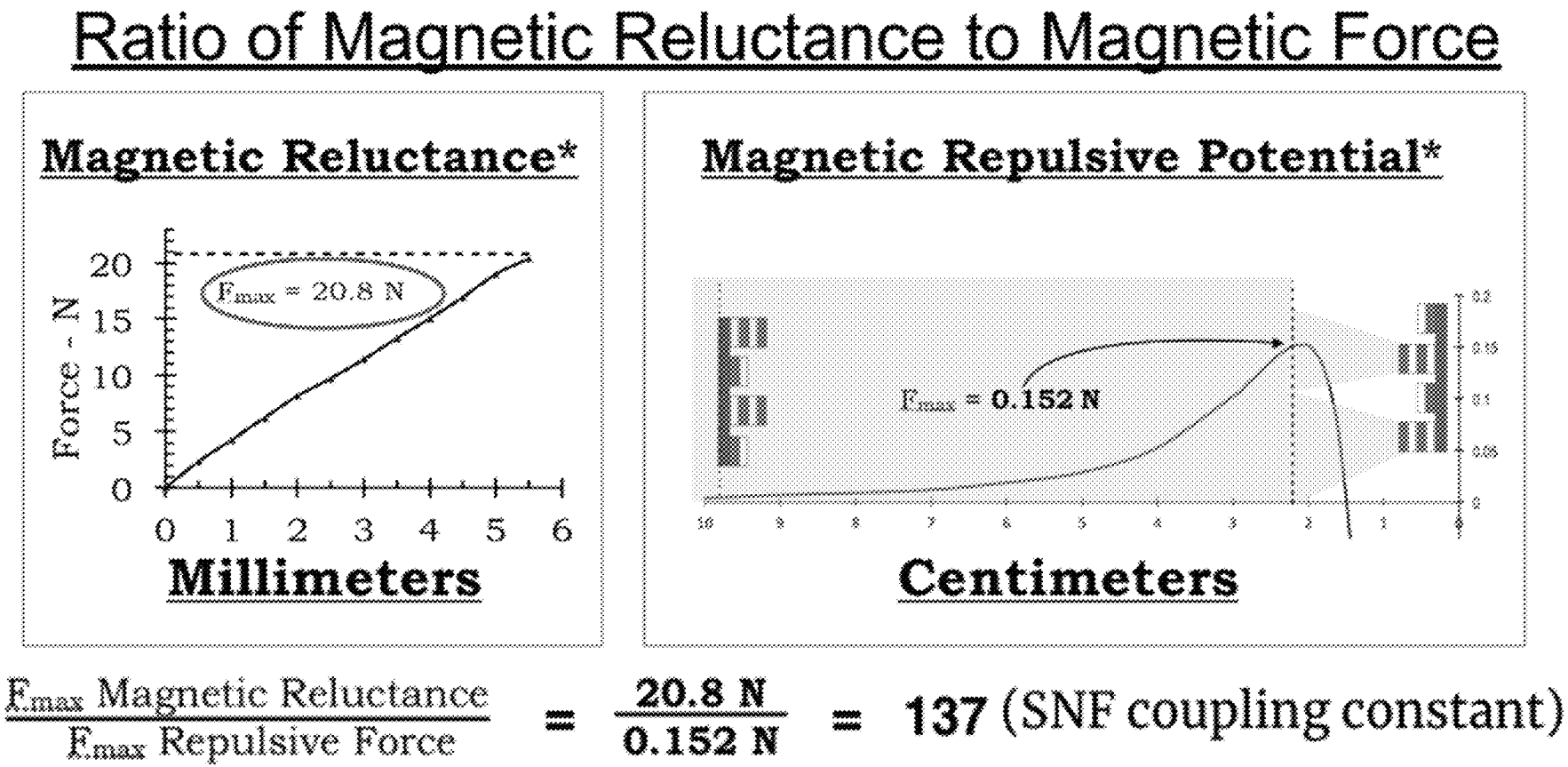
FIG. 25 shows a linear reluctance curve with a calculation.

FIG. 24 illustrates a unique property of magnet arrays called magnetic reluctance. This arise from a shear force applied to separate two coupled arrays. The sideways or shear force required to slide one array off the other is initially small but increases with distance. This generates a linear and increasing force/displacement curve in sharp contrast to the inverse square curve generated by pulling the arrays directly apart. The maximum force required is the same in both instances. This linear increasing force is characteristically similar to the strong force binding nucleons and quarks together within the nucleus.

FIG. 15 calculates the ratio of the maximum reluctance force to the maximum repulsive force to yield a close approximation of the strong force coupling constant 137.

Figure 26:
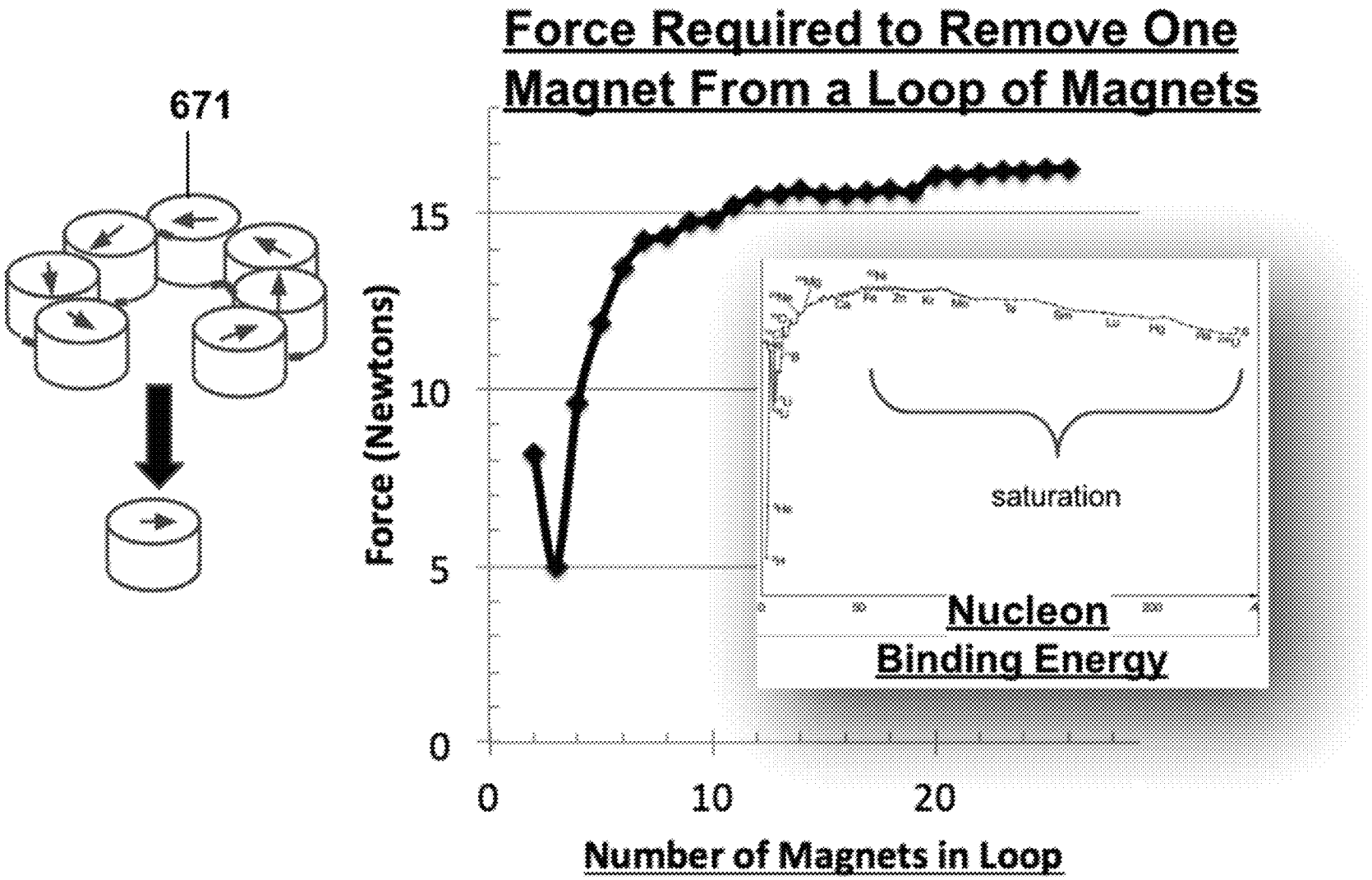
FIG. 26 shows the saturation curve of a loop of magnets.

FIG. 26 illustrates how a loop of diametrically magnetized magnets 671 can be used to demonstrate the concept of saturation found within the nucleon binding curve. Here the force required to separate a single magnet from a loop of coupled magnets is plotted against the number of magnets in the loop.

Figure 27:
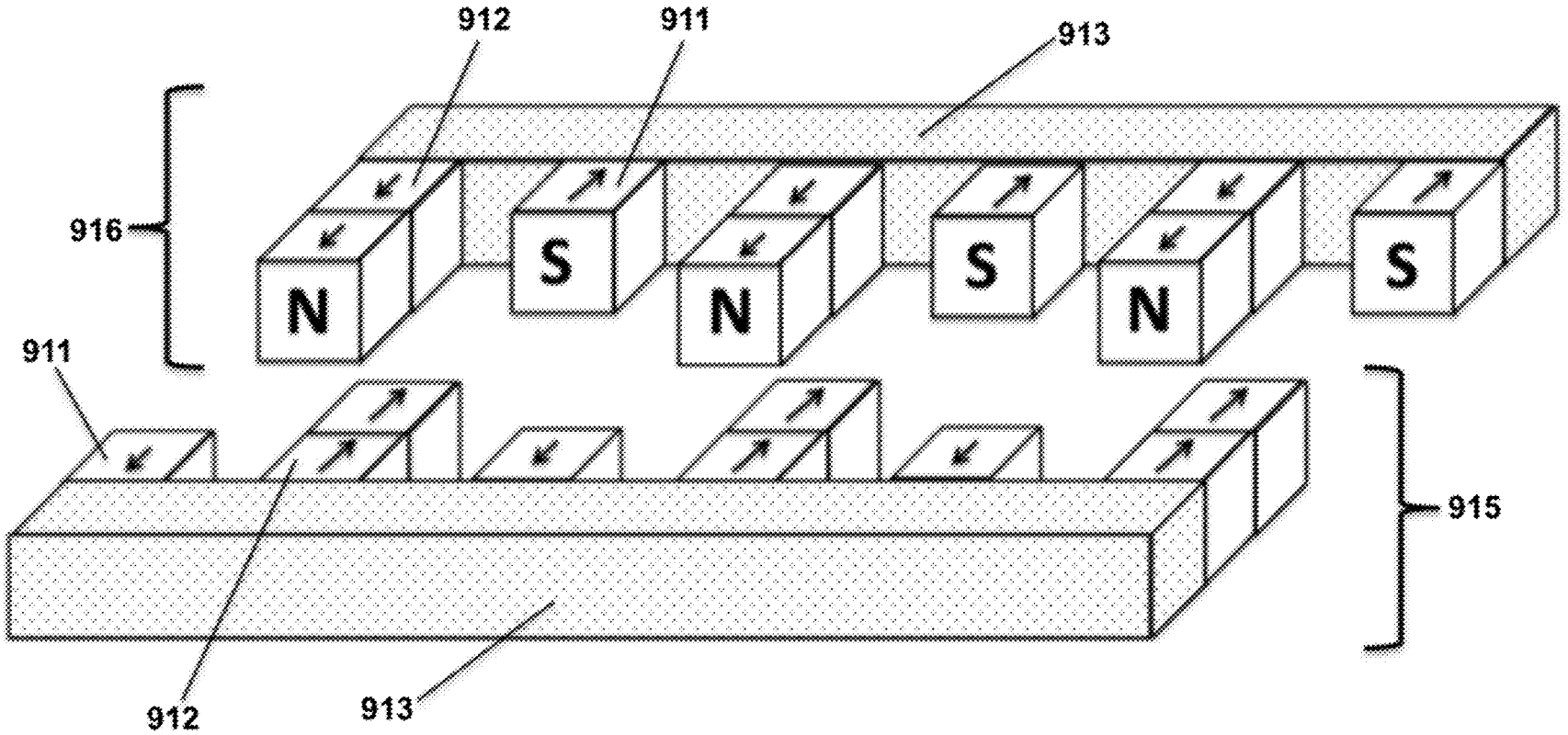
FIG. 27 shows an embodiment of a permanent magnet potential energy barrier.

FIG. 27 illustrates a pair of opposing deuteron analogs. Double north facing magnets 912 are attached to frame 913 adjacent to single south facing magnet 911, also attached to frame 914. Alternating magnets are attached so their magnetic poles are parallel. The south facing magnet on array 915 is aligned with the north facing magnet 912 on array 916.

Although specific aspects of the disclosure have been illustrated and described for purposes of illustration, it will be understood that various modifications may be made without departing from the spirit and scope of the disclosure. Accordingly, the invention should not be limited except as by the appended claims.

What is claimed is:

1. A permanent magnet potential energy barrier assembly comprising:

a first permanent magnet array attached to a first frame, the first permanent magnet array including one or more first permanent magnets having a first polarity, and positioned parallel and adjacent to one or more second permanent magnets having a second polarity, respectively, so that the first permanent magnets alternate with the second permanent magnets;

the first permanent magnets selected such that the sum of the pull forces of the first permanent magnets is greater than the sum of the pull forces of the second permanent magnets;

a second permanent magnet array attached to a second frame, the second permanent magnet array including one or more third permanent magnets having the first polarity positioned parallel and adjacent to one or more fourth permanent magnets having the second polarity, respectively, so that the third permanent magnets alternate with the fourth permanent magnets;

the third permanent magnets selected such that the sum of the pull forces of the third permanent magnets is greater than the sum of the forces of the fourth permanent magnets; and the first frame positioned opposite to the second frame so that the first permanent magnets oppose the fourth permanent magnets and the second permanent magnets oppose the third permanent magnets.

2. The permanent magnet potential barrier assembly of claim 1 wherein the second permanent magnets are recessed in the first frame relative to the first permanent magnets, and the fourth permanent magnets are recessed in the second frame relative to the third permanent magnets.

3. The permanent magnet potential barrier assembly of claim 1 wherein the first polarity is north and the second polarity is south.

4. The permanent magnet potential barrier assembly of claim 1 wherein the first polarity is south and the second polarity is north.

5. The permanent magnet potential barrier assembly of claim 1 wherein the first frame is a first disc attached rotatably and slidably to a shaft, and the second frame is attached rotatably and slidably to the shaft, and the shaft is attached to a base.

6. A method of generating an electromagnetic potential energy barrier, the method comprising:

selecting a predominant electromagnetic pole of a first polarity and a lesser electromagnetic pole having a polarity opposite to the first polarity;

selecting a magnitude of the predominant pole approximately double a magnitude of the lesser pole;

grouping a plurality of predominant poles with a plurality of lesser poles into an alternating sequential array so that predominant poles alternate with lesser poles;

positioning each predominant pole a first distance apart from the nearest adjacent lesser pole; and recessing each lesser pole a second distance relative to each first predominant pole so that the first distance is approximately double the second distance, so that the electromagnetic field alternates in polarity in the near-range and resolves into a single predominant electromagnetic field in the far-range.

* * * * *